US009904198B2

(12) United States Patent
Omori et al.

(10) Patent No.: US 9,904,198 B2
(45) Date of Patent: Feb. 27, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Hiroki Omori, Kanagawa (JP); Mona Tasaki, Kanagawa (JP); Yutaka Saito, Kanagawa (JP); Yuka Yamagishi, Kanagawa (JP); Fusako Kiyono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/130,435

(22) Filed: Apr. 15, 2016

(65) Prior Publication Data

US 2017/0184989 A1 Jun. 29, 2017

(30) Foreign Application Priority Data

Dec. 25, 2015 (JP) ..... 2015-254490

(51) Int. Cl.

| | |
|---|---|
| ***G03G 9/097*** | (2006.01) |
| ***G03G 9/087*** | (2006.01) |
| ***G03G 9/08*** | (2006.01) |

(52) U.S. Cl.

CPC ..... *G03G 9/09791* (2013.01); *G03G 9/0819* (2013.01); *G03G 9/0821* (2013.01); *G03G 9/0825* (2013.01); *G03G 9/08755* (2013.01); *G03G 9/08764* (2013.01)

(58) Field of Classification Search

CPC ..... G03G 9/09791; G03G 9/0821; G03G 9/08755; G03G 9/08764

See application file for complete search history.

(56) References Cited

U.S. PATENT DOCUMENTS

| | | | | |
|---|---|---|---|---|
| 8,795,938 | B2 * | 8/2014 | Uchinokura | G03G 9/08 430/108.3 |
| 2006/0222986 | A1 * | 10/2006 | Veregin | G03G 9/0806 430/108.3 |
| 2006/0251978 | A1 * | 11/2006 | Pickering | G03G 9/0823 430/108.4 |
| 2009/0214966 | A1 * | 8/2009 | Kishida | G03G 9/0804 430/48 |
| 2011/0053073 | A1 | 3/2011 | Isono et al. | |
| 2016/0147166 | A1 * | 5/2016 | Sugiura | G03G 9/0819 430/105 |

FOREIGN PATENT DOCUMENTS

| | | | |
|---|---|---|---|
| JP | 2010-079242 | A | 4/2010 |
| JP | 2013-164477 | A | 8/2013 |
| JP | 2014170118 | A * | 9/2014 |

* cited by examiner

*Primary Examiner* — Christopher D Rodee
(74) *Attorney, Agent, or Firm* — Oliff PLC

(57) ABSTRACT

An electrostatic charge image developing toner includes toner particles containing a binder resin and a release agent; and an external additive containing fatty acid metal salt particles, wherein a non-attachment rate representing a percentage of the fatty acid metal salt particles not attached to the toner particles before ultrasonic desorption treatment is 45% or less and a weak attachment rate representing a percentage determined by subtracting the non-attachment rate from a percent of the fatty acid metal salt particles not attached to the toner particles after ultrasonic desorption treatment is 55% or more.

20 Claims, 4 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-254490 filed Dec. 25, 2015.

BACKGROUND

1. Technical Field

The present invention relates to an electrostatic charge image developing toner, an electrostatic charge image developer, and a toner cartridge.

2. Related Art

A method of visualizing image information through an electrostatic charge image, such as electrophotography, is currently used in various fields. In electrophotography, the image information is formed on a surface of an image holding member as an electrostatic charge image through a charging process and an exposure process, a toner image is developed on the surface of the image holding member using a developer containing a toner, and this toner image is visualized as an image through a transfer process of transferring the toner image to a recording medium and a fixing process of fixing the toner image onto a surface of the recording medium.

SUMMARY

According to an aspect of the invention, there is provided an electrostatic charge image developing toner including:

toner particles containing a binder resin and a release agent; and an external additive containing fatty acid metal salt particles, wherein a non-attachment rate representing a percentage of the fatty acid metal salt particles not attached to the toner particles before ultrasonic desorption treatment is 45% or less, and a weak attachment rate representing a percentage determined by subtracting the non-attachment rate from a percent of the fatty acid metal salt particles not attached to the toner particles after ultrasonic desorption treatment is 55% or more.

BRIEF DESCRIPTION OF THE DRAWINGS

Exemplary embodiments of the present invention will be described in detail based on the following figures, wherein.

DETAILED DESCRIPTION

Figure 1:
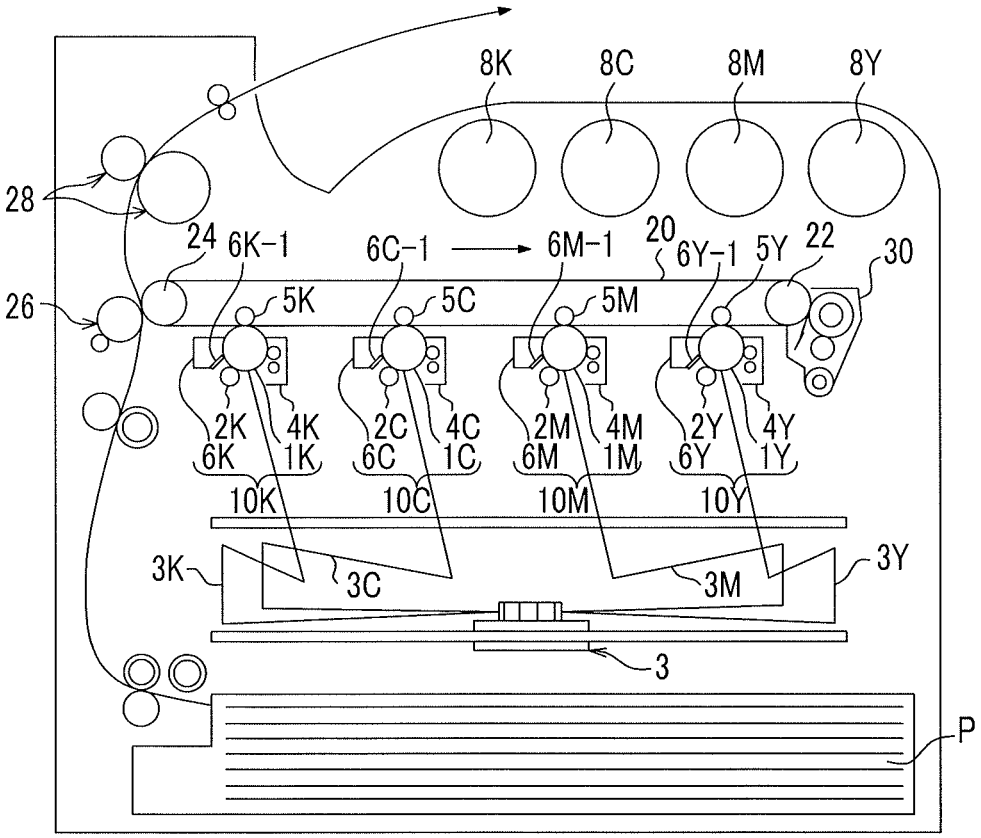
FIG. 1 is a schematic configuration diagram showing an example of an image forming apparatus according to the exemplary embodiment.

Hereinafter, exemplary embodiments which are examples of the invention will be described in detail.

Electrostatic Charge Image Developing Toner

An electrostatic charge image developing toner according to the exemplary embodiment (hereinafter, also simply referred to as a "toner") includes toner particles containing a binder resin and a release agent, and an external additive containing fatty acid metal salt particles. A non-attachment rate representing a percentage of the fatty acid metal salt particles not attached to the toner particles of the toner before ultrasonic desorption treatment is equal to or smaller than 45%, and in the toner after the ultrasonic desorption treatment, a weak attachment rate representing a percentage determined by subtracting the non-attachment rate from a percent of the fatty acid metal salt particles not attached to the toner particles of the toner after the ultrasonic desorption treatment is equal to or greater than 55%.

The toner according to the exemplary embodiment prevents occurrence of positional deviation of an image (hereinafter, the positional deviation of an image is also referred to as a "out of color registration") by the configurations described above. The reasons thereof are not clear but the following is assumed.

When an image is formed using an electrophotographic image forming apparatus including a cleaning unit including a cleaning blade, after a toner image on the image holding member is transferred, a part of the toner remains on an image holding member. When the residual toner reaches the cleaning blade, an accumulated material of the toner (toner dam) is formed, and accordingly, cleaning properties are improved. The residual toner is scraped by the cleaning blade and the surface of the image holding member is cleaned.

For example, in order to maintain stable cleaning properties, an image may be formed using a toner including toner particles and an external additive containing fatty acid metal salt particles. In a case of forming an image using this toner, the fatty acid metal salt particles are contained in the external additive, and accordingly, an aggregation force of the accumulated material of the toner is increased and the toner dam is reinforced. In addition, when the fatty acid metal salt particles are contained in the external additive, lubricity of the cleaning blade is increased.

For example, it is proposed to provide a toner having excellent cleaning properties, charging stability, filming properties, toner interchangeability and low-temperature fixability by adjusting a toner complete isolation rate and a weak attachment rate of the fatty acid metal salt particles in specific ranges, respectively. However, it is found that, in a case where images having high image density (for example, image density of 80%) are continuously formed using this toner, for example, positional deviation of an image easily occurs in the formed images. Particularly, occurrence of the positional deviation of an image is remarkably observed, when images having high image density are continuously formed in a high-temperature high-humidity environment (for example, a temperature of 40° C. and humidity of 90% RH).

The reasons for the occurrence of out of color registration are assumed as follows, for example.

In the toner including the toner particles and the external additive containing the fatty acid metal salt particles, the toner having a low non-attachment rate of the fatty acid metal salt particles in the toner (percentage of the fatty acid metal salt particles not attached to the toner particles; for example, a percentage of fatty acid metal salt particles separated from the toner particles when the toner is dispersed in an aqueous medium, even when the fatty acid metal salt particles come into contact with the toner particles) (for example, equal to or smaller than 45%) and a low weak attachment rate (for example, a percentage of the fatty acid metal salt particles isolated by the ultrasonic desorption treatment) (for example, smaller than 55%) has an increased strong attachment rate of the fatty acid metal salt particles (for example, a percentage of the fatty acid metal salt particles not isolated even by the ultrasonic desorption treatment).

In a case where an image is formed using this toner, the amount of the fatty acid metal salt particles isolated from the toner particles is easily decreased in the surface of the image holding member. Accordingly, when the toner image formed on the image holding member is transferred to a transfer medium, the amount of the fatty acid metal salt particles contained in the transferred toner image is easily increased.

When the toner image transferred to the transfer medium approaches a fixing unit, the toner image is fixed by the fixing unit (for example, a fixing roll). At that time, the fatty acid metal salt particles contained in the toner image are attached to the surface of the fixing unit, and accordingly, a coating film of fatty acid metal salt is easily formed. Particularly, when images having high image density are continuously formed, the amount of the fatty acid metal salt particles contained in the toner image is further increased and the amount of the fatty acid metal salt particles attached to the surface of the fixing unit is also easily increased at the same time. Therefore, a coefficient of friction of the surface of the fixing unit tends to be decreased. As a result, in the fixing unit, a recording medium easily slides, deviation of an unfixed image easily occurs, and thus, it is considered that the out of color registration easily occurs in the formed image.

With respect to this, the toner of the exemplary embodiment has a weak attachment rate equal to or greater than 55%, and accordingly, the fatty acid metal salt particles attached to the toner particles are controlled so that a percentage of the fatty acid metal salt particles attached with a weak force is great. Accordingly, the amount of the fatty acid metal salt particles isolated from the toner particles is easily increased in the surface of the image holding member. Therefore, the amount of the fatty acid metal salt particles contained in the toner image transferred onto the transfer medium is easily decreased. As a result, compared to a case where an image is formed using a toner having a low weak attachment rate of the fatty acid metal salt particles, the amount of the fatty acid metal salt particles contained in the toner image transferred onto the transfer medium is easily decreased, the amount of the fatty acid metal salt particles coated on the surface of the fixing unit is also decreased, and thus, a decrease in the coefficient of friction of the surface of the fixing unit is easily prevented. Therefore, it is considered that occurrence of the out of color registration in the formed image is prevented. In addition, the toner of the exemplary embodiment has a weak attachment rate equal to or greater than 55%, and accordingly, it is considered that occurrence of the out of color registration in the formed image is easily prevented, particularly, even in a case where images having high image density are continuous printed in the high temperature high humidity environment using the toner of the exemplary embodiment.

As described above, it is assumed that the toner according to the exemplary embodiment prevents occurrence of the positional deviation of an image (out of color registration) with the configurations described above.

Some fatty acid metal salt particles are present in a state of being not attached to the toner particles in the toner. When a percentage of the fatty acid metal salt particles present in a state of being not attached to the toner particles is increased, fluidity of the toner is easily decreased, and accordingly, transporting properties of the toner are easily decreased. When the transporting properties of the toner are decreased, a supply amount of the toner into a developing device is decreased, and accordingly, image density in the formed image is easily decreased.

With respect to this, since a non-attachment rate of the fatty acid metal salt particles in the toner according to the exemplary embodiment is equal to or smaller than 45%, a decrease in the fluidity of the toner is prevented and accordingly, a decrease in the transporting properties of the toner are prevented. Therefore, the toner according to the exemplary embodiment also prevents a decrease in the image density accompanied with a decrease in the fluidity of the toner.

Hereinafter, the toner according to the exemplary embodiment will be described in detail.

The toner according to the exemplary embodiment includes toner particles and an external additive containing fatty acid metal salt particles. The external additive contains other external additives, if necessary, in addition to the fatty acid metal salt particles.

Toner Particles

The toner particles, for example, contains a binder resin and a release agent, and if necessary, a colorant and other additives.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known polyester resin is included.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

A weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using HLC-8120 GPC, which is GPC manufactured by Tosoh Corporation as a measurement device by using TSKgel Super HM-M (15 cm), which is a column manufactured by Tosoh Corporation. The weight average molecular weight and the number average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Herein, as the polyester resin, a modified polyester resin is also used, in addition to the unmodified polyester resin described above. The modified polyester resin is a polyester resin in which a bonding group other than an ester bond is present, and a polyester resin in which a resin component other than the polyester resin component is bonded by covalent bonding or ionic bonding. As the modified polyester resin, a resin including a terminal modified by allowing a reaction between a polyester resin in which a functional group such as an isocyanate group reacting with an acid group or a hydroxyl group is introduced to a terminal, and an active hydrogen compound is used.

As the modified polyester resin, a urea-modified polyester resin is particularly preferable. When the urea-modified polyester resin is contained as the binder resin, it is easy to further prevent occurrence of out of color registration. This is because it is considered that an adhesive force between the toner particles and the fatty acid metal salt particles is easily improved and a weak attachment rate of the fatty acid metal salt particles is easily controlled in a well-known rage, by crosslinking and chemical structures of the urea-modified polyester resin (specifically, physical properties of a resin obtained by crosslinking of the urea-modified polyester resin and chemical properties of affinity between a bonding group having polarity and the fatty acid metal salt particles having polarity). From this viewpoint, the content of the urea-modified polyester resin is preferably from 5% by weight to 50% by weight and more preferably from 7% by weight to 20% by weight with respect to the entire binder resin.

As the urea-modified polyester resin, a urea-modified polyester resin obtained by a reaction (at least one reaction of a crosslinking reaction and an extension reaction) between a polyester resin (polyester prepolymer) including an isocyanate group and an amine compound is preferable. The urea-modified polyester resin may contain a urea bond and an urethane bond.

As a polyester prepolymer including an isocyanate group, a prepolymer obtained by allowing a reaction of a polyvalent isocyanate compound with respect to polyester which is a polycondensate of polyvalent carboxylic acid and polyol and includes active hydrogen is used. Examples of a group including active hydrogen included in polyester include a hydroxyl group (alcoholic hydroxyl group and phenolic hydroxyl group), an amino group, a carboxyl group, and a mercapto group, and an alcoholic hydroxyl group is preferable.

As polyvalent carboxylic acid and polyol of the polyester prepolymer including an isocyanate group, the compounds same as polyvalent carboxylic acid and polyol described in the section of the polyester resin are used.

Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate (α,α,α',α'-tetramethylxylylene diisocyanate); isocyanurates; and a component obtained by blocking the polyisocyanate by a blocking agent such as a phenol derivative, oxime, or caprolactam.

The polyvalent isocyanate compounds may be used singly or in combination of two or more kinds thereof.

A ratio of the polyvalent isocyanate compound is preferably from 1/1 to 5/1, more preferably from 1.2/1 to 4/1, and even more preferably from 1.5/1 to 2.5/1, as an equivalent ratio [NCO]/[OH] of an isocyanate group [NCO] and a hydroxyl group of a polyester prepolymer including a hydroxyl group [OH]. When the ratio [NCO]/[OH] is from 1/1 to 5/1, occurrence of the out of color registration is further prevented. When the ratio [NCO]/[OH] is equal to or smaller than 5, a decrease in the low-temperature fixability is easily prevented.

In the polyester prepolymer including an isocyanate group, the content of a component derived from the polyvalent isocyanate compound is preferably from 0.5% by weight to 40% by weight, more preferably from 1% by weight to 30% by weight, and even more preferably from 2% by weight to 20% by weight, with respect to the entire polyester prepolymer including an isocyanate group. When the content of a component derived from the polyvalent isocyanate is from 0.5% by weight to 40% by weight, occurrence of the out of color registration is further prevented. When the content of a component derived from the polyvalent isocyanate is equal to or smaller than 40% by weight, a decrease in the low-temperature fixability is easily prevented.

The number of isocyanate groups contained per 1 molecule of the polyester prepolymer including an isocyanate group is preferably equal to or greater than 1, more preferably from 1.5 to 3, and even more preferably from 1.8 to 2.5, each on an average. When the number of isocyanate groups is equal to or greater than 1 per 1 molecule, the molecular weight of the urea-modified polyester resin after the reaction increases and occurrence of the out of color registration is further prevented.

Examples of the amine compound to be reacted with the polyester prepolymer including an isocyanate group include diamine, tri- or higher valent polyamine, amino alcohol, amino mercaptan, amino acid, and a compound obtained by blocking these amino groups.

Examples of diamine include aromatic diamine (phenylene diamine, diethyl toluene diamine, or 4,4'diaminodiphenylmethane); alicyclic diamine (4,4'-diamino-3,3'dimethyl dicyclohexyl methane, diamine cyclohexane, or isophorone diamine); and aliphatic diamine (ethylenediamine, tetramethylenediamine, or hexamethylenediamine).

Examples of tri- or higher valent polyamine include diethylenetriamine and triethylenetetramine.

Examples of amino alcohol include ethanolamine and hydroxyethyl aniline.

Examples of amino mercaptan include aminoethyl mercaptan and aminopropyl mercaptan.

Examples of amino acid include aminopropionic acid and aminocaproic acid.

Examples of a compound obtained by blocking these amino groups include a ketimine compound and an oxazoline compound obtained from an amine compound such as diamine, tri- or higher valent polyamine, amino alcohol, amino mercaptan, or amino acid and a ketone compound (acetone, methyl ethyl ketone, or methyl isobutyl ketone).

Among these amino compounds, a ketimine compound is preferable.

The amino compounds may be used singly or in combination of two or more kinds thereof.

The urea-modified polyester resin may be a resin in which the molecular weight after the reaction is adjusted by adjusting a reaction between the polyester resin including an isocyanate group (polyester prepolymer) and an amine compound (at least one reaction of the crosslinking reaction and the extension reaction), using a stopper which stops at least one reaction of the crosslinking reaction and the extension reaction (hereinafter, also referred to as a "crosslinking/extension reaction stopper").

Examples of the crosslinking/extension reaction stopper include monoamine (diethylamine, dibutylamine, butylamine, or laurylamine) and a component obtained by blocking those (ketimine compound).

A ratio of the amine compound is preferably from 1/2 to 2/1, more preferably from 1/1.5 to 1.5/1, and even more preferably from 1/1.2 to 1.2/1, as an equivalent ratio [NCO]/[NHx] of an isocyanate group [NCO] of the polyester prepolymer including an isocyanate group and an amino group [NHx] of amines. When the ratio [NCO]/[NHx] is in the range described above, the molecular weight of the urea-modified polyester resin after the reaction increases and occurrence of the out of color registration is further prevented.

A glass transition temperature of the urea-modified polyester resin is preferably from 40° C. to 65° C. and more preferably from 45° C. to 60° C. A number average molecular weight (Mn) is preferably from 2,500 to 50,000 and more preferably from 2,500 to 30,000. A weight average molecular weight (Mw) is preferably from 10,000 to 500,000 and more preferably from 30,000 to 100,000.

The content of the binder resin is, for example, preferably in a range of from 40% by weight to 95% by weight, more preferably in a range of from 50% by weight to 90% by weight, and further preferably in a range of from 60% by weight to 85% by weight relative to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used singly or in combination of two or more types thereof.

If necessary, the colorant may be surface-treated or used in combination with a dispersing agent. Plural types of colorants may be used in combination.

The content of the colorant is, for example, preferably in a range of from 1% by weight to 30% by weight, and more preferably in a range of from 3% by weight to 15% by weight relative to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters; and the like. The release agent is not limited to these examples.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K7121-1987.

The content of the release agent is, for example, preferably in a range of from 1% by weight to 20% by weight, and more preferably in a range of from 5% by weight to 15% by weight relative to the entire toner particles.

Other Additives

Examples of other additives include known additives such as a magnetic material, a charge controlling agent, and inorganic powder. The toner particles contain these additives as internal additives.

Characteristics of Toner Particles

The toner particles may be toner particles having a single-layer structure, or be toner particles having a so-called core/shell structure composed of a core (core particle) and a coating layer (shell layer) coated on the core.

Here, toner particles having a core/shell structure is preferably composed of, for example, a core containing a binder resin, and if necessary, other additives such as a colorant and a release agent, and a coating layer containing a binder resin.

The volume average particle diameter (D50v) of the toner particles is preferably in a range of from 2 μm to 10 μm, and more preferably in a range of from 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

In order to more easily prevent occurrence of the out of color registration, the toner particles have a sea-island structure including a sea portion containing a binder resin and an island portion including a release agent (that is, the toner particles have a sea-island structure in which a release agent is present in a continuous phase of a binder resin so as to have an island shape), a maximum frequent value in distribution of eccentricity B of the island portion represented by the above-described expression is preferably from 0.71 to 1.00, and a skewness in the distribution of the eccentricity B is preferably from −1.10 to −0.50.

Next, the toner particle having the above-described characteristics is described below. The eccentricity B of the island portion containing the release agent (also referred to as a "release agent domain" below) in the toner particle is an index indicating a distance of the centroid of the release agent domain from the centroid of the toner particle. A larger value of the eccentricity B indicates that the release agent domain exists closer to the surface of the toner particle. A smaller value of the eccentricity B indicates that the release agent domain exists closer to the center of the toner particle. The maximum frequent value in the distribution of the eccentricity B indicates a portion at which the release agent domain exists in the largest amount in a radial direction of the toner particle. The skewness of the distribution of the eccentricity B indicates bilateral symmetry of the distribution. Specifically, the skewness of the distribution of the eccentricity B indicates a degree of unevenness from the maximum frequent value in the distribution. That is, the skewness of the distribution of the eccentricity B indicates a degree of the distribution of the release agent domain from the portion where the release agent domain exists in the largest amount in the diameter direction of the toner particle.

Figure 4:
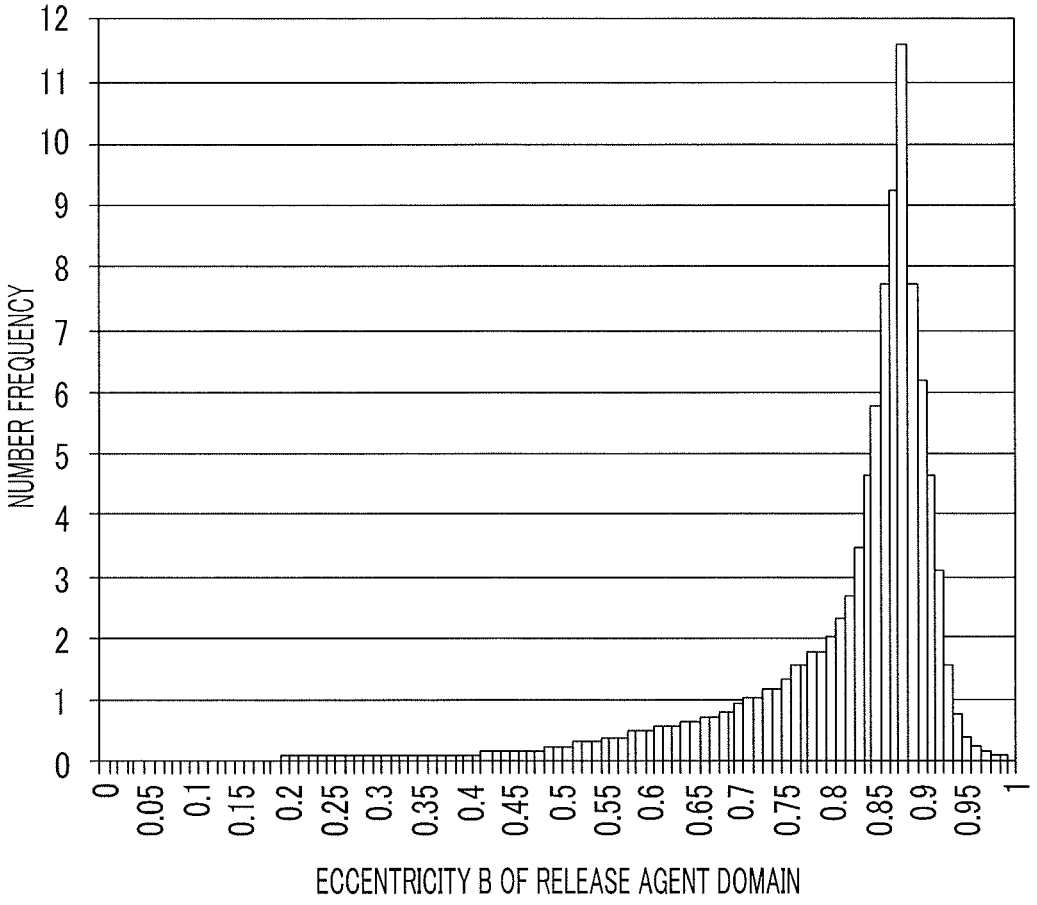
FIG. 4 is a view showing distribution of eccentricity B of a release agent domain of a toner particle according to the exemplary embodiment.

That is, the maximum frequent value in the distribution of the eccentricity B of the release agent domain being in a range of from 0.71 to 1.00 means that the release agent domain exists in the largest amount at a position close to a surface layer portion of the toner particle. The skewness of the distribution of the eccentricity B of the release agent domain being in a range of from −1.10 to −0.50 means that the release agent domain is distributed inwardly from the surface layer portion of the toner particle with a gradient (see FIG. 4).

In this manner, the toner particle in which the maximum frequent value and the skewness of the distribution of the eccentricity B of the release agent domain respectively satisfy the above-described ranges is a toner in which the release agent domain exists in the largest amount in the vicinity of the surface layer portion and is distributed to the vicinity of the surface layer portion from the inside of the toner particle with a gradient.

In the toner particle having the characteristics described above, the largest amount of the release agent is present in the surface portion.

Accordingly, when the toner particles have the characteristics, it is easy to further prevent occurrence of the out of color registration. The reason thereof is not clear but assumed as follows. When the release agent is present in the surface layer portion of the toner particles, affinity between the toner particles and the fatty acid metal salt particles is increased, and accordingly, the fatty acid metal salt particles are easily attached to the surface of the toner particles. As a result, it is considered that the reason thereof is because that the weak attachment rate of the fatty acid metal salt particles is easily controlled in the well-known range and occurrence of the out of color registration is further prevented.

In the toner particle having a sea-island structure, the maximum frequent value in distribution of the eccentricity B of the release agent domain (island portion containing the release agent) is preferably from 0.75 to 0.99, more preferably from 0.80 to 0.98, and even more preferably from 0.85 to 0.97, in order to further prevent occurrence of the out of color registration.

The skewness in the distribution of the eccentricity B of the release agent domain (island portion containing the release agent) is from −1.10 to −0.50, preferably from −1.00 to −0.60, and more preferably from −0.95 to −0.65, in order to further prevent occurrence of the out of color registration.

A confirming method of the sea and island structure of the toner particle will be described.

The sea and island structure of the toner particle is confirmed, for example, by a method of observing a cross-section of the toner particle using a transmission electron microscope, or a method of dyeing a cross-section of the toner particle with ruthenium tetroxide and observing the dyed cross-section using a scanning electron microscope. The method of observation using a scanning electron microscope is preferable in that the release agent domain in the cross-section of the toner particle may be observed more clearly. As the scanning electron microscope, a model which has been known well to those skilled in the related art may be used. For example, SU8020 manufactured by Hitachi High-Technologies Corporation, JSM-7500F manufactured by JEOL Ltd., and the like are included.

Specifically, an observing method is performed as follows. First, a toner particle to be measured is embedded in an epoxy resin, and then the epoxy resin is cured. This cured substance is cut into a thin section with a microtome including a diamond blade to thereby obtain an observation sample in which a cross-section of the toner particle is exposed. Dyeing with ruthenium tetroxide is performed on the thin observation sample and the cross-section of the toner particle is observed by using a scanning electron microscope. Using this observing method, a sea and island structure in which a release agent having a brightness difference (contrast) caused by a dyeing degree with respect to a continuous phase of a binder resin exists so as to have an island shape in the cross-section of the toner particle is observed.

Next, a measuring method of the eccentricity B of the release agent domain will be described.

The eccentricity B of the release agent domain is measured as follows. First, an image is recorded at magnification which allows a cross-section of one toner particle to come in sight, by using the confirming method of the sea and island structure. Image analysis for the recorded image is performed under a condition of 0.010000 μm/pixel by using image analysis software (WINROOF manufactured by MITANI Corporation). A shape of the cross-section of the toner particle is extracted by this image analysis by using a brightness difference (contrast) between the epoxy resin used in embedding and the binder resin of the toner particle. A projected area is obtained based on the extracted shape of the cross-section of the toner particle. An equivalent circle diameter is obtained from the projected area. An equivalent circle diameter is obtained from the projected area. The equivalent circle diameter is calculated by an expression of $2\sqrt{(\text{projected area}/\pi)}$. The obtained equivalent circle diameter is set as an equivalent circle diameter D of the toner particle in observation of the cross-section of the toner particle.

A centroid position is obtained based on the extracted shape of the cross-section of the toner particle. Subsequently, a shape of the release agent domain is extracted by using a brightness difference (contrast) between the binder resin and the release agent, and a centroid position of the release agent domain is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner or the extracted release agent domain is set as n, xy coordinates of each pixel are set as $x_i$ and $y_i$ (i=1, 2, . . . , n). A distance between the centroid position of the cross-section of the toner particle and the centroid position of the release agent domain is obtained. The obtained distance is set as a distance d from the centroid of the toner particle to the centroid of the island portion containing the release agent in observation of the cross-section of the toner particle.

At last, the eccentricity B of the release agent domain is obtained based on each of the equivalent circle diameter D and the distance d by using Expression (1) (eccentricity B=2d/D). Similarly, the above-described operation is performed on each of plural release agent domains in the cross-section of one toner particle and thereby the eccentricity B of the release agent domain is obtained.

Next, a calculating method of the maximum frequent value in distribution of the eccentricity B of the release agent domain will be described.

First, the eccentricity B of the release agent domain for 200 toner particles is measured as described above. Data of the obtained eccentricity B of each of the release agent domains is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the release agent domain is obtained. The value of this data section is set as the maximum frequent value in the distribution of the eccentricity B of the release agent domain.

Next, a calculating method of the skewness in the distribution of the eccentricity B of the release agent domain will be described.

First, the distribution of the eccentricity B of the release agent domain is obtained as described above. The skewness in the distribution of the eccentricity B is obtained based on the following expression. In the following expression, the skewness is set as Sk, the number of pieces of data of the eccentricity B of the release agent domain is set as n, values of data of the eccentricity B of the respective release agent domains are set as $x_i$(i=1, 2, . . . , n), an average value of all pieces of data of the eccentricity B of the release agent domain is set as x (x with a bar above), and a standard deviation of all pieces of data of the eccentricity B of the release agent domain is set as s.

$$Sk = \frac{n}{(n-1)(n-2)} \sum_{i=1}^{n} \left( \frac{x_i - \bar{x}}{s} \right)^3 \quad \text{Expression 1}$$

A method for satisfying distribution characteristics of the eccentricity B of the release agent domain in toner particles will be described in a method of preparing the toner.

External Additive

Fatty Acid Metal Salt Particles

The toner of the exemplary embodiment includes fatty acid metal salt particles as an external additive. The fatty acid metal salt particles are particles of salt formed of fatty acid and metal.

Fatty acid may be any of saturated fatty acid and unsaturated fatty acid. The number of carbon atoms of fatty acid is from 10 to 25 (preferably, from 12 to 22). The number of carbon atoms of fatty acid includes carbon atoms of a carboxyl group.

Specific examples of fatty acid include saturated fatty acid such as behenic acid, stearic acid, palmitic acid, myristic acid, or lauric acid; unsaturated fatty acid such as oleic acid, linoleic acid, or ricinoleic acid; and the like. Among these fatty acids, stearic acid and lauric acid are preferable and stearic acid is more preferable.

As the metal, divalent metal may be used. Specific examples of metal include magnesium, calcium, aluminum, barium, and zinc. Among these, zinc is preferable.

Specific examples of the fatty acid metal salt particles include particles of metal salt of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, or sodium stearate; metal salt of palmitic acid such as zinc palmitate, cobalt palmitate, copper palmitate, magnesium palmitate, aluminum palmitate, or calcium palmitate; metal salt of lauric acid such as zinc laurate, manganese laurate, calcium laurate, iron laurate, magnesium laurate, or aluminum laurate; metal salt of oleic acid such as zinc oleate, manganese oleate, iron oleate, aluminum oleate, copper oleate, magnesium oleate, or calcium oleate; and metal salt of linoleic acid such as zinc linoleate, cobalt linoleate, and calcium linoleate; and metal salts of ricinoleic acid such as zinc ricinoleate or aluminum ricinoleate.

Among these, particles of metal salt of stearic acid or metal salt of lauric acid are preferable, particles of zinc stearate or zinc laurate are more preferable, and zinc stearate particles are even more preferable, as the fatty acid metal salt particles, from viewpoints of cleaning properties and material availability.

A method of preparing the fatty acid metal salt particles is not particularly limited, and examples thereof include a method of performing cationic substitution of fatty acid alkali metal salt; a method of directly causing a reaction between fatty acid and metal hydroxide; and the like.

When a method of preparing the zinc stearate particles as the fatty acid metal salt particles is used as an example, examples the method include a method of performing cationic substitution of sodium stearate; a method of causing a reaction between stearic acid and zinc hydroxide; and the like.

The amount of the fatty acid metal salt particles externally added may be from 0.02 parts by weight to 5 parts by weight, and is preferably from 0.05 parts by weight to 3.0 parts by weight and more preferably from 0.08 parts by weight to 1.0 parts by weight with respect to 100 parts by weight of the toner particles.

Volume Average Particle Diameter of Fatty Acid Metal Salt Particles

A volume average particle diameter of the fatty acid metal salt particles is preferably from 0.1 μm to 10 μm and more preferably from 0.5 μm to 3 μm.

The volume average particle diameter of the fatty acid metal salt particles may be measured by the following method, for example.

1 g of the toner which is a measurement target is put in a 1 L-beaker and 500 g of a 5% aqueous solution of a surfactant (preferably sodium alkylbenzene sulfonate) is added thereto. After applying ultrasonic waves and isolating the external additives from the toner particles, centrifugation is performed. Since the concentration of the fatty acid metal salt particles is less than 1 and the concentration of the toner is generally equal to or greater than 1, the fatty acid metal salt particles are contained in a supernatant after the centrifugation. 2 ml of this supernatant is added to 100 ml to 150 ml of an electrolyte (ISOTON-II manufactured by Beckman Coulter, Inc.), and subjected to a dispersion treatment using an ultrasonic disperser for 1 minute, to obtain a sample for measurement. Particle diameters of 50,000 particles having a particle diameter of 2 μm to 60 μm are measured using a COULTER MULTISIZER II (aperture diameter of 100 μm, manufactured by Beckman Coulter, Inc.). Cumulative distributions by volume are drawn from the side of the smallest diameter and the particle diameter when the cumulative percentage becomes 50% is defined as that corresponding to a volume average particle diameter (D50v).

Particle Diameter Ratio of Toner Particles and Fatty Acid Metal Salt Particles

In the toner of the exemplary embodiment, when the volume average particle diameter of the toner particles is set as a and the volume average particle diameter of the fatty acid metal salt particles is set as b, it is preferable that a ratio (a/b) of the volume average particle diameter a of the toner particles and the volume average particle diameter b of the fatty acid metal salt particles satisfies a relationship of $2.5 \leq a/b \leq 7$.

When the ratio (a/b) of the volume average particle diameter a of the toner particles and the volume average particle diameter b of the fatty acid metal salt particles is in the range described above, it is easy to further prevent occurrence of the out of color registration.

It is more preferable that the ratio (a/b) satisfies a relationship of $3.0 \leq a/b \leq 6.0$ and it is even more preferable that the ratio (a/b) satisfies a relationship of $4.0 \leq a/b \leq 5.5$.

Attachment State of Fatty Acid Metal Salt Particles to Toner Particles

The fatty acid metal salt particles are present in the toner in a state of being separated from the toner particles when the toner is dispersed in an aqueous medium which will be described later and not attached to the toner particles (non-attachment), a state of being isolated by the ultrasonic desorption treatment which will be described later and attached to the toner particles with a weak force (weak attachment), and a state of being not isolated even by the ultrasonic desorption treatment which will be described later and attached to the toner particles with a strong force (strong attachment).

That is, regarding the percentage of the fatty acid metal salt particles present in the toner, the total of the percentage of the state of the fatty acid metal salt particles not attached to the toner particles (non-attachment rate), the percentage of the state of the fatty acid metal salt particles weakly attached to the toner particles (weak attachment rate), and the percentage of the state of the fatty acid metal salt particles strongly attached to the toner particles (strong attachment rate) is 100%.

In this specification, the "non-attachment rate" indicates the percentage of the fatty acid metal salt particles not attached to the toner particles in the toner before the ultrasonic desorption treatment. Specifically, the non-attachment rate indicates a percentage determined from the amount of the fatty acid metal salt particles in the toner separated from the toner particles when the toner is dispersed in an aqueous medium, with respect to the amount of the fatty acid metal salt particles contained in the toner (untreated toner).

Herein, the "state of the fatty acid metal salt particles not attached to the toner particles" indicates a state where the fatty acid metal salt particles are separated from the toner particles by the treatment when the toner is dispersed in an aqueous medium, even when the fatty acid metal salt particles come into contact with the toner particles in the toner. That is, the "state of the fatty acid metal salt particles not attached to the toner particles" is a state where the fatty acid metal salt particles not coming into contact with the toner particles and the fatty acid metal salt particles coming into contact with the toner particles are mixed in the toner, before the toner is dispersed in an aqueous medium.

In this specification, the "weak attachment rate" indicates a percentage of the state of the fatty acid metal salt particles attached to the toner particles with a weak force and a percentage determined by subtracting the non-attachment rate described above from the percentage of the fatty acid metal salt particles not attached to the toner particles in the toner after the ultrasonic desorption treatment. Specifically, the "weak attachment rate" indicates a percentage obtained by calculating a percentage obtained from the amount of the fatty acid metal salt particles in the toner separated from the toner particles when the toner is dispersed in an aqueous medium and the fatty acid metal salt particles are subjected to the desorption treatment by applying ultrasonic waves, with respect to the amount of the fatty acid metal salt particles contained in the toner (untreated toner) and subtracting the non-attachment rate described above from this percentage.

The ultrasonic desorption treatment indicates treatment of desorbing the fatty acid metal salt particles by applying ultrasonic waves.

The non-attachment rate of the fatty acid metal salt particles is equal to or smaller than 45%. The non-attachment rate is preferably equal to or smaller than 30%, more preferably equal to or smaller than 25%, and even more preferably smaller than 25%. Meanwhile, a lower limit of the non-attachment rate is not particularly limited and is preferably 0%.

When the non-attachment rate of the fatty acid metal salt particles is in the range described above, a decrease in the image density is prevented. Particularly, a decrease in the image density is easily prevented in the case where an image having high image density is formed in the high temperature high humidity environment.

The weak attachment rate of the fatty acid metal salt particles is equal to or greater than 55%. The weak attachment rate is preferably equal to or greater than 60%, more preferably equal to or greater than 65%, and even more preferably equal to or greater than 75%, and particularly preferably greater than 75%. Meanwhile, an upper limit of the weak attachment rate is not particularly limited and is more preferably equal to or smaller than 100%.

When the weak attachment rate of the fatty acid metal salt particles is in the range described above, occurrence of the out of color registration is prevented. Particularly, occurrence of the out of color registration when an image having high image density is formed in the high temperature high humidity environment, is easily prevented.

The strong attachment rate of the fatty acid metal salt particles is not particularly limited. An upper limit of the strong attachment rate is smaller than 25% and is preferably equal to or smaller than 20%, in order to prevent occurrence of out of color registration. Meanwhile, a lower limit of the strong attachment rate may be 0%.

The strong attachment rate indicates a percentage of the remainder when the weak attachment rate and the non-attachment rate are subtracted from 100%.

Details of a measurement method of the non-attachment rate and the weak attachment rate of the fatty acid metal salt particles in the toner are as follows.

First, 3.75 g of the toner which is a measurement target is put in 0.5% surfactant (NOIGEN ET-165 manufactured by DKS Co., Ltd.) aqueous solution, and stirred at a rotation rate to an extent of not foaming using a table roll mill for 30 minutes, and a toner dispersion A is prepared.

Next, the ultrasonic desorption treatment is performed with respect to this toner dispersion A. The ultrasonic waves are applied to the toner dispersion A (height of an ultrasonic vibrating unit from the bottom surface of 1.0 cm, intensity of 40 W, for 1 minute) using an ultrasonic homogenizer (VCX 750 manufactured by Sonics & Materials, Inc.), and a toner dispersion B is prepared.

Then, the toner dispersion B is moved to a centrifuge tube and centrifugation is performed at 2,000 rpm for 2 minutes. Suction filtration is performed using a material obtained by discarding a supernatant after the centrifugation and adding 60 mL pure water to precipitated toner as a dispersion slurry (KIRIYAMA-ROHTO FILTER PAPER No. 5C having an aperture size of 60ϕm/m, manufactured by Kiriyama Glass. Co., Ltd.). After the filtering, the toner remaining on the filter paper is collected and suction filtering is performed for cleaning using pure water 60 mL as a dispersion slurry. After cleaning, the toner remaining on the filter paper is collected and dried in a thermostatic oven at 40° C. for 8 hours. 3 g of the obtained toner is molded in a pellet having a diameter of 30 mm and a thickness of 2 mm using an automatic press-molding device (BRE-32 manufactured by Maekawa Testing Machine MFG. Co., Ltd.) under the conditions of a load of 6.0 t and pressing time of 60 seconds, to obtain a sample. The sample prepared by performing the ultrasonic desorption treatment by applying the ultrasonic waves is set as a sample 1 (sample after the ultrasonic desorption treatment).

Then, the toner which is not subjected to the treatment is separately molded in a pellet having a diameter of 30 mm and a thickness of 2 mm under the conditions of a load of 6.0 t and pressing time of 60 seconds, to obtain a sample 0 (untreated sample).

A sample prepared by the same procedures as those of the above process except for omitting the ultrasonic desorption treatment is set as a sample 2 (sample before the ultrasonic desorption treatment).

Next, quantitative analysis is performed by a fluorescence X-ray device (ZSX-100e manufactured by Rigaku Corporation). The content of metal elements of each sample is measured. As the content of metal elements, each rate is calculated by a calibration curve created in advance.

The non-attachment rate is calculated by the following Expression (A).

$$\text{Non-attachment rate}=\{(C_0-C_2)/C_0\}\times 100 \qquad \text{Expression (A)}$$

(herein, $C_0$ represents the content of metal elements of the sample 0 and $C_2$ represents the content of metal elements of the sample 2).

The weak attachment rate is calculated by the following Expression (Z).

$$\text{Weak attachment rate}=[\{(C_0-C_1)/C_0\}\times 100]-\text{non-attachment rate} \qquad \text{Expression (Z)}$$

(herein, $C_0$ represents the content of metal elements of the sample 0 and $C_1$ represents the content of metal elements of the sample 1).

Other External Additives

Other external additives may be externally added to the toner, in addition to the fatty acid metal salt particles. Examples of the other external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O^2$ $(TiO_2)_n$, $Al_2O_3.2SiO_2$, $CaCO_3$, $MgCO_3$, $BaSO_4$, and $MgSO_4$.

Surfaces of the inorganic particles as the other external additives are preferably treated with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, from 1 part by weight to 10 parts by weight with respect to 100 parts by weight of the inorganic particles.

Examples of the other external additives also include resin particles (resin particles such as polystyrene, polymethyl methacrylate (PMMA), and melamine resin) and a cleaning aid (e.g., fluorine polymer particles).

The amount of the other external additives externally added is, for example, preferably from 0.01% by weight to 5% by weight, and more preferably from 0.01% by weight to 2.0% by weight with respect to the toner particles.

Toner Preparing Method

Next, a method of preparing the toner according to the exemplary embodiment will be described.

The toner according to the exemplary embodiment is obtained by externally adding an external additive containing the fatty acid metal salt particles to toner particles, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Particularly, when preparing a toner (toner particles) which satisfies the distribution characteristics of the eccentricity B of the release agent domain as described above, the toner particles may preferably be prepared by an aggregation and coalescence method described below.

In the aggregation and coalescence method described below, a method of preparing a toner (toner particles) also containing a colorant will be described, but the colorant is an additive contained in the toner particles, if necessary.

Specifically, the toner particles are preferably prepared by processes as follows: a process of preparing each dispersion (dispersion preparation process); a process (first aggregated particle forming process); a process (second aggregated particle forming process); a process (third aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture slowly increases. Thus, the second resin particles and the release agent particles are aggregated on a surface of the first aggregated particles, and thereby second aggregated particles are formed. In the third aggregated particle forming process, after a second aggregated particle dispersion in which the second aggregated particles are dispersed is prepared, the second aggregated particle dispersion and a third resin particle dispersion in which the third resin particles corresponding to the binder resin are dispersed are further mixed with each other. Thus, the third resin particles are aggregated so as to be attached to a surface of the second aggregated particles, and thereby third aggregated particles are formed. In the coalescence process, a third aggregated particle dispersion in which the third aggregated particles are dispersed is heated to coalesce the third aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed slowly or while increasing the concentration of the release agent particles increases. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, a third resin particle dispersion in which third resin particles corresponding to the binder resin are dispersed, and a release agent particle dispersion in which release agent particles are dispersed are prepared.

In the dispersion preparation process, descriptions will be made, referring the first resin particles, the second resin particles and the third resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture slowly.

The second resin particles may be the same type as or a different type or from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles slowly. The dispersion is heated at a temperature which is equal to or less than the glass transition temperature of the second resin particles.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture slowly, the concentration (abundance ratio) of the release agent particles becomes slowly larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 3:
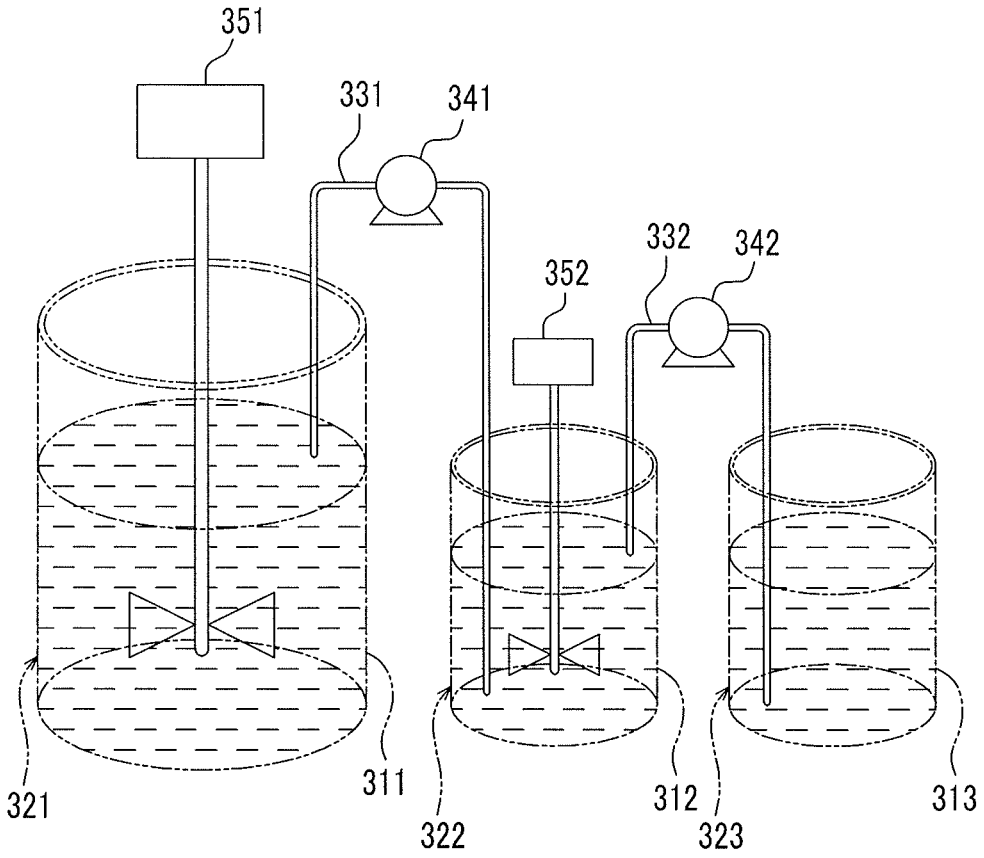
FIG. 3 is a schematic view for illustrating a power feed adding method.

FIG. 3 illustrates an apparatus used in the power feeding addition method. In FIG. 3, the reference numeral 311 indicates the first aggregated particle dispersion, the reference numeral 312 indicates the second resin particle dispersion, the reference numeral 313 indicates the release agent particle dispersion.

The apparatus illustrated in FIG. 3 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 3, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher slowly. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the distribution characteristics of the release agent domain of the toner are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the distribution characteristics of the release agent domain of the toner are adjusted.

Specifically, for example, the maximum frequent value in the distribution of the eccentricity B of the release agent domain is adjusted depending on a period of time when transporting of the release agent particle dispersion to the second storage tank 322 from the third storage tank 323 is ended. More specifically, for example, if transporting of the release agent particle dispersion to the second storage tank 322 from the third storage tank 323 is ended before liquid transporting to the first storage tank 321 from the second storage tank 322 is ended, the concentration of the release agent particles in the dispersion mixture of the second storage tank 322 does not increase from that point of time. Thus, the maximum frequent value in the distribution of the eccentricity B of the release agent domain becomes smaller.

For example, the skewness in the distribution of the eccentricity B of the release agent domain is adjusted depending on a period of time when the dispersions are respectively transported from the second storage tank 322 and the third storage tank 323, and a liquid transport speed at which the dispersion is transported to the first storage tank 321 from the second storage tank 322. More specifically, for example, if a liquid transport starting time of the release agent particle dispersion from the third storage tank 323 and a liquid transport starting time of the dispersion from the second storage tank 322 are early, and the liquid transport speed of the dispersion from the second storage tank 322 is lowered, a state where the release agent particles are disposed from a further inner side of the formed aggregated particle to a further outer side thereof is realized. Thus, the skewness in the distribution of the eccentricity B of the release agent domain becomes greater.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Third Aggregated Particle Forming Process

Next, after the second aggregated particle dispersion in which the second aggregated particles are dispersed is obtained, the second aggregated particle dispersion and the third resin particle dispersion in which the third resin particles corresponding to the binder resin are dispersed are further mixed with each other.

The third resin particles may be the same type as or a different type from the first or second resin particles.

The third resin particles are aggregated on surfaces of the second aggregated particles in a dispersion in which the second aggregated particles and the third resin particles are dispersed. Specifically, for example, in the second aggregated particle forming process, when a particle diameter of the second aggregated particle reaches a desired particle diameter, the third resin particle dispersion is added to the second aggregated particle dispersion, and the dispersion is heated at a temperature which is equal to or lower than the glass transition temperature of the third resin particles.

The aggregation proceeding is stopped, by setting the pH of the dispersion to be in a range of approximately 6.5 to 8.5, for example.

Coalescence Process

Next, the third aggregated particle dispersion in which the third aggregated particles are dispersed is heated at, for example, a temperature that is equal to or higher than the glass transition temperature of the first, second, and third resin particles (for example, a temperature that is higher than the glass transition temperature of the first, second, and third resin particles by 10° C. to 30° C.) to coalesce the third aggregated particles and form toner particles.

Toner particles are obtained through the foregoing processes.

By performing the foregoing processes, the distribution characteristics of the eccentricity B of the release agent domain in the obtained toner particles (toner) are in the range described above.

After the coalescence process is ended, toner particles formed in a solution are subjected to a well-known washing process, a well-known solid-liquid separation process, a well-known drying process, and thereby dried toner particles are obtained.

Regarding the washing process, replacing washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

Next, a case of preparing a toner including toner particles containing a urea-modified polyester resin will be described.

The toner particles containing the urea-modified polyester resin as a binder resin may be obtained by the following dissolution and suspension method. In addition, a method of obtaining toner particles containing the unmodified polyester resin and the urea-modified polyester resin as the binder resin will be described, but the toner particles may contain only the urea-modified polyester resin as the binder resin.

Oil-Phase Solution Preparation Process

An oil-phase solution obtained by dissolving or dispersing a toner particle material containing the unmodified polyester resin, the polyester prepolymer including an isocyanate group, the amine compound, a brilliant pigment, and a release agent in an organic solvent is prepared (oil-phase solution preparation process). This oil-phase solution preparation process is a step of dissolving or dispersing the toner particle material in an organic solvent to obtain a mixed solution of the toner material.

The oil-phase solution is prepared by methods such as 1) a method of preparing an oil-phase solution by collectively dissolving or dispersing the toner material in an organic solvent, 2) a method of preparing an oil-phase solution by kneading the toner material in advance and dissolving or dispersing this kneaded material in an organic solvent, 3) a method of preparing an oil-phase solution by dissolving the unmodified polyester resin, the polyester prepolymer including an isocyanate group, and the amine compound in an organic solvent and dispersing a brilliant pigment and the release agent in the organic solvent, 4) a method of preparing an oil-phase solution by dispersing a brilliant pigment and the release agent in the organic solvent and dissolving the unmodified polyester resin, the polyester prepolymer including an isocyanate group, and the amine compound in the organic solvent, 5) a method of preparing an oil-phase solution by dissolving or dispersing toner particle materials other than the polyester prepolymer including an isocyanate group and the amine compound (the unmodified polyester resin, a brilliant pigment, and the release agent) in an organic solvent and dissolving the polyester prepolymer including an isocyanate group and the amine compound in the organic solvent, or 6) a method of preparing an oil-phase solution by dissolving or dispersing toner particle materials other than the polyester prepolymer including an isocyanate group or the amine compound (the unmodified polyester resin, a brilliant pigment, and the release agent) in an organic solvent and dissolving the polyester prepolymer including an isocyanate group or the amine compound in the organic solvent. The method of preparing the oil-phase solution is not limited thereto.

Examples of the organic solvent of the oil-phase solution include an ester solvent such as methyl acetate or ethyl acetate; a ketone solvent such as methyl ethyl ketone or methyl isopropyl ketone; an aliphatic hydrocarbon solvent such as hexane or cyclohexane; a halogenated hydrocarbon solvent such as dichloromethane, chloroform or trichloroethylene. It is preferable that these organic solvents dissolve the binder resin, a rate of the organic solvent dissolving in water is from approximately 0% by weight to 30% by weight, and a boiling point is equal to or lower than 100° C. Among the organic solvents, ethyl acetate is preferable.

Suspension Preparation Process

Next, a suspension is prepared by dispersing the obtained oil-phase solution in a water-phase solution (suspension preparation process).

A reaction between the polyester prepolymer including an isocyanate group and the amine compound is performed together with the preparation of the suspension. The urea-modified polyester resin is formed by this reaction. This reaction is performed with at least one reaction of the crosslinking reaction and the extension reaction of molecular chains. This reaction between the polyester prepolymer including an isocyanate group and the amine compound may be performed with the following organic solvent removing process.

Herein, the reaction conditions are selected according to reactivity between the structure of isocyanate group included in the polyester prepolymer and the amine compound. As an example, a reaction time is preferably from 10 minutes to 40 hours and more preferably from 2 hours to 24 hours. A reaction temperature is preferably from 0° C. to 150° C. and more preferably from 40° C. to 98° C. In addition, a well-known catalyst (dibutyltin laurate or dioctyltin laurate) may be used if necessary, in the formation of the urea-modified polyester resin. That is, a catalyst may be added to the oil-phase solution or the suspension.

As the water-phase solution, a water-phase solution obtained by dispersing a particle dispersing agent such as an organic particle dispersing agent or an inorganic particle dispersing agent in an aqueous solvent is used. In addition, as the water-phase solution, a water-phase solution obtained by dispersing a particle dispersing agent in an aqueous solvent and dissolving a polymer dispersing agent in an aqueous solvent is also used. Further, a well-known additive such as a surfactant may be added to the water-phase solution.

As the aqueous solvent, water (for example, generally ion exchange water, distilled water, or pure water) is used. The aqueous solvent may be a solvent containing water and an organic solvent such as alcohol (methanol, isopropyl alcohol, or ethylene glycol), dimethylformamide, tetrahydrofuran, cellosolves (methyl cellosolve), or lower ketones (acetone or methyl ethyl ketone).

As the organic particle dispersing agent, a hydrophilic organic particle dispersing agent is used. As the organic particle dispersing agent, particles of poly(meth)acrylic acid alkyl ester resin (for example, a polymethyl methacrylate resin), a polystyrene resin, or a poly(styrene-acrylonitrile) resin are used. As the organic particle dispersing agent, particles of a styrene acrylic resin are also used.

As the inorganic particle dispersing agent, a hydrophilic inorganic particle dispersing agent is used. Specific examples of the inorganic particle dispersing agent include particles of silica, alumina, titania, calcium carbonate, magnesium carbonate, tricalcium phosphate, clay, diatomaceous earth, or bentonite, and particles of calcium carbonate are preferable. The inorganic particle dispersing agent may be used singly or in combination of two or more kinds thereof.

The surface of the particle dispersing agent may be subjected to surface treatment by a polymer including a carboxyl group.

As the polymer including a carboxyl group, a copolymer of at least one kind selected from salts (alkali metal salt, alkaline earth metal salt, ammonium salt, amine salt) in which α,β-monoethylenically unsaturated carboxylic acid or a carboxyl group of α,β-monoethylenically unsaturated carboxylic acid is neutralized by alkali metal, alkaline earth metal, ammonium, or amine, and α,β-monoethylenically unsaturated carboxylic acid ester is used. As the polymer including a carboxyl group, salt (alkali metal salt, alkaline earth metal salt, ammonium salt, amine salt) in which a carboxyl group of a copolymer of α,β-monoethylenically unsaturated carboxylic acid and α,β-monoethylenically unsaturated carboxylic acid ester is neutralized by alkali metal, alkaline earth metal, ammonium, or amine is also used. The polymer including a carboxyl group may be used singly or in combination with two or more kinds thereof.

Representative examples of α,β-monoethylenically unsaturated carboxylic acid include α,β-unsaturated monocarboxylic acid (acrylic acid, methacrylic acid, or crotonic acid), and α,β-unsaturated dicarboxylic acids (maleic acid, fumaric acid, or itaconic acid). Representative examples of α,β-monoethylenically unsaturated carboxylic acid ester include alkyl esters of (meth)acrylate, (meth)acrylate including an alkoxy group, (meth)acrylate including a cyclohexyl group, (meth)acrylate including a hydroxy group, and polyalkylene glycol mono(meth)acrylate.

As the polymer dispersing agent, a hydrophilic polymer dispersing agent is used. As the polymer dispersing agent, specifically, a polymer dispersing agent which includes a carboxyl group and does not include lipophilic group (hydroxypropoxy group or a methoxy group) (for example, water-soluble cellulose ether such as carboxymethyl cellulose or carboxyethyl cellulose) is used.

Solvent Removing Process

Next, a toner particle dispersion is obtained by removing an organic solvent from the obtained suspension (solvent removing process). The solvent removing process is a process of forming toner particles by removing the organic solvent contained in liquid droplets of the water-phase solution dispersed in the suspension. The method of removing the organic solvent from the suspension may be performed immediately after the suspension preparation process or may be performed after 1 minute or longer, after the suspension preparation process.

In the solvent removing process, the organic solvent may be removed from the suspension by cooling or heating the obtained suspension to have a temperature in a range of 0° C. to 100° C., for example.

As a specific method of the organic solvent removing method, the following method is used.

(1) A method of allowing airflow to blow to the suspension to forcibly update a gas phase on the surface of the suspension. In this case, gas may flow into the suspension.

(2) A method of reducing pressure. In this case, a gas phase on the surface of the suspension may be forcibly updated due to filling with gas or gas may further blow into the suspension.

The toner particles are obtained through the above-mentioned processes.

Herein, after the solvent removing process ends, the toner particles formed in the toner particle dispersion are subjected to a well-known washing process, a well-known solid-liquid separation process, and a well-known drying process, and thereby dried toner particles are obtained.

Regarding the washing process, replacing washing using ion exchanged water may preferably be sufficiently performed for charging property.

The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The toner according to the exemplary embodiment is prepared by adding and mixing the external additives to and with the dried toner particles obtained, for example.

A method of mixing the toner particles and the external additives with each other is not particularly limited, as long as the toner of the exemplary embodiment is obtained.

However, when the toner particles and the external additive containing the fatty acid metal salt particles are mixed with each other at once using a HENSCHEL MIXER, for example, an adhesion force between the toner particles and the external additive containing the fatty acid metal salt particles may become excessively strong. Accordingly, the toner particles and the external additive containing the fatty acid metal salt particles may be mixed with each other, by the following mixing method, for example. When the toner particles and the external additive containing the fatty acid metal salt particles are mixed with each other by this method, a toner having satisfied non-attachment rate and weak attachment rate of the well-known fatty acid metal salt particles is easily obtained.

Specifically, first, the toner particles and the external additives other than the fatty acid metal salt particles are mixed with each other using a mixing device (for example, a V blender, a HENSCHEL MIXER, a LÖdige mixer, or the like) to obtain a mixture. After sieving this mixture using a wind classifier (for example, HI-BOLTER), the sieved mixture is collected using a collector (for example, CYCLONE). When collecting the sieved mixture using the collector, the fatty acid metal salt particles are added thereto, to obtain a toner including the toner particles and the external additive containing the fatty acid metal salt particles.

In the adjustment of the non-attachment rate and the weak attachment rate when the mixing is performed by the method described above, a method of changing the time from the addition of the fatty acid metal salt particles to the collector to the starting of the stopping operation of the collector is used.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic particle are coated with a coating resin; a magnetic particle dispersion-type carrier in which a magnetic particle is dispersed and blended in a matrix resin; and a resin impregnation-type carrier in which a magnetic particle is impregnated with a resin.

The magnetic particle dispersion-type carrier and the resin impregnation-type carrier may be carriers in which constituent particles of the carrier are cores and coated with a coating resin.

Examples of the magnetic particle include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, a cleaning unit includes a cleaning blade that cleans the surface of the image holding member, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, a cleaning process of cleaning the surface of the image holding member with a cleaning blade, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

An example of the image forming apparatus according to this exemplary embodiment will be described below. However, it is not limited thereto. Main components illustrated in the drawings will be described and descriptions of other components will be omitted.

FIG. 1 is a schematic configuration diagram illustrating the image forming apparatus according to this exemplary embodiment.

The image forming apparatus illustrated in FIG. 1 includes first to fourth electrophotographic image forming units 10Y, 10M, 10C, and 10K (image forming units) that respectively print yellow (Y), magenta (M), cyan (C), and black (K) images based on color-separated image data. These image forming units (which may be simply referred to as "units" below) 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing so as to extend through the units. The intermediate transfer belt 20 is wound on a driving roller 22 and a support roller 24 contacting the inner surface of the intermediate transfer belt 20, which are separated from each other on the left and right sides in the drawing, and the intermediate transfer belt 20 travels in a direction toward the fourth unit 10K from the first unit 10Y. A force is applied to the support roller 24 in a direction in which it departs from the driving roller 22 by a spring or the like (not illustrated), and a tension is applied to the intermediate transfer belt 20 wound on both of the rollers. In addition, an intermediate transfer member cleaning device 30 is provided on a surface of the intermediate transfer belt 20 on the photoreceptor side so as to face the driving roller 22.

The developers including toners of four colors are respectively stored in developing devices (developing units) 4Y, 4M, 4C, and 4K of the units 10Y, 10M, 10C, and 10K. Further, a yellow toner, a magenta toner, a cyan toner, and a black toner contained in toner cartridges 8Y, 8M, 8C, and 8K are respectively supplied to the developing devices 4Y, 4M, 4C, and 4K.

The first to fourth units 10Y, 10M, 10C, and 10K have the same configuration. Thus, only the first unit 10Y that is disposed on the upstream side in a traveling direction of the intermediate transfer belt and forms a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that includes a cleaning blade 6Y-1 that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image which is formed on the surface of the photoreceptor 1Y by charging, and is a so-called negative latent image, which is formed by applying the laser beams 3Y to the photosensitive layer so that the specific resistance of the irradiated part is decreased to cause charges on the surface of the photoreceptor 1Y to flow while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at this developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the cleaning blade 6Y-1 of the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
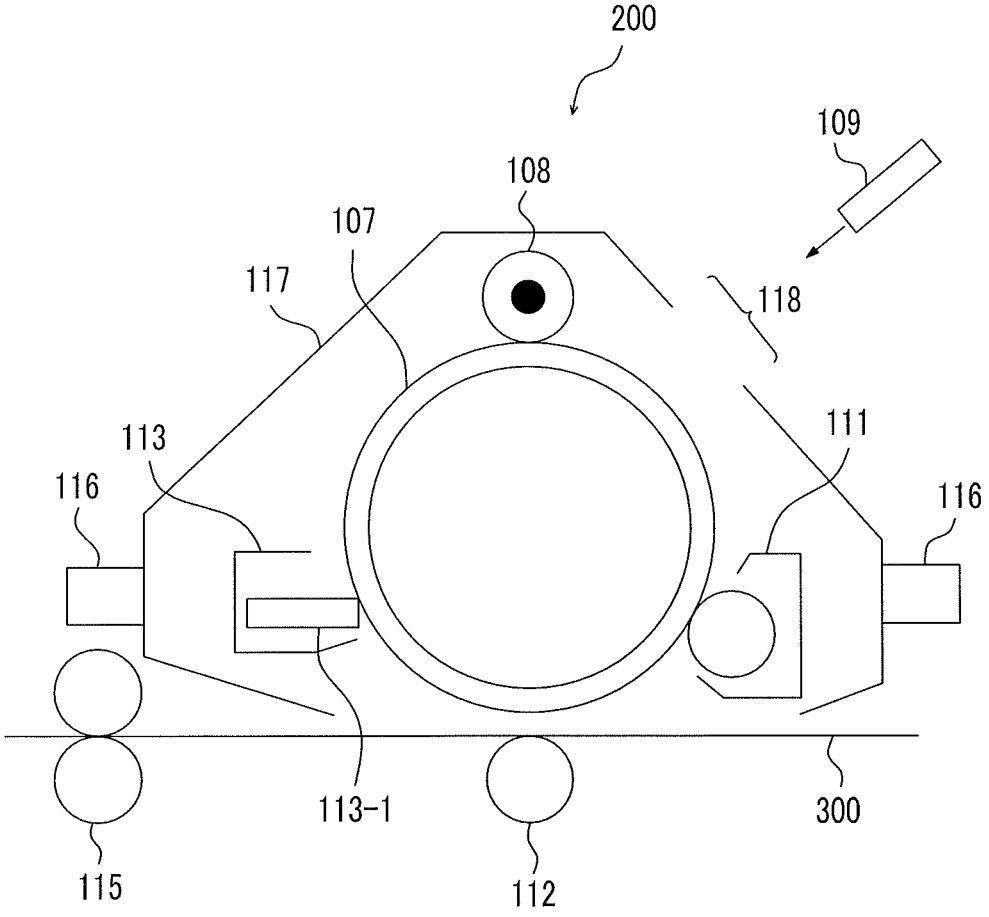
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) including a cleaning blade 113-1, which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus. The toner cartridge may have a container that contains the toner.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

The exemplary embodiments will be described more specifically with reference to examples and comparative examples, but the exemplary embodiments are not limited to the following examples. Unless specifically noted, "parts" and "%" represent "parts by weight" and "% by weight".

Preparation of Fatty Acid Metal Salt Particles

Preparation of Zinc Stearate Particles (ZnSt1) to (ZnSt3)

1,422 parts of stearic acid is added to 10,000 parts of ethanol and mixed at a solution temperature of 75° C., 507 parts of zinc hydroxide is slowly added thereto, and stirred and mixed for 1 hour after finishing the addition. After that, the product is cooled at a solution temperature of 20° C. and filtered to remove ethanol and the reaction residue, and a solid material is taken out. The obtained solid material is dried using a heating-type vacuum drying machine at 150° C. for 3 hours. The solid material is taken out from the drying machine and cooled, and thus, a solid material of zinc stearate is obtained.

The obtained solid material is pulverized by a jet mill and classified by an elbow jet classifier (manufactured by MATSUBO Corporation), and thus, zinc stearate particles (Znst1) are obtained.

Zinc stearate particles (Znst2) and (Znst3) are obtained by the same method as the preparation of the zinc stearate particles (Znst1), except for adjusting the pulverization performed using a jet mill.

Volume average particle diameters of the obtained zinc stearate (Znst1) to (Znst3) measured by the well-known method are as follows.

zinc stearate particles (Znst1): 1.2 μm zinc stearate particles (Znst2): 0.9 μm zinc stearate particles (Znst3): 1.5 μm Preparation of Zinc Laurate Particles (Zula1)

1,001 parts of lauric acid is added to 10,000 parts of ethanol and mixed at a solution temperature of 75° C., 507 parts of zinc hydroxide is slowly added thereto, and stirred and mixed for 1 hour after finishing the addition. After that, the product is cooled at a solution temperature of 20° C. and filtered to remove ethanol and the reaction residue, and the obtained solid material is dried using a heating-type vacuum drying machine at 150° C. for 3 hours. The solid material is taken out from the drying machine and cooled, and thus, a solid material of zinc laurate is obtained. The obtained solid material is pulverized and classified in the same manner as in the case of the zinc stearate particles (Znst1) and thus, zinc laurate particles are obtained.

A volume average particle diameter of the obtained zinc laurate measured by the well-known method is as follows.

zinc laurate particles (Zula1): 1.5 μm

Preparation of Toner Particles A

Preparation of Polyester Resin Dispersion (1)

| | |
|---|---|
| 1,9-nonanediol: | 45 parts by mol |
| Dodecane dicarboxylic acid: | 55 parts by mol |

The above components are put in a heated and dried three-necked flask. 0.05 parts by mol of dibutyl tin oxide is further added as a catalyst. Then, air in the vessel is turned into an inert atmosphere with nitrogen gas by performing pressure reducing operation, and the mixture is stirred and refluxed by mechanical stirring at 180° C. for 2 hours. After that, the temperature is slowly increased to 230° C. under the reduced pressure, the mixture is stirred for 5 hours, and at the time when a viscous state is obtained, air cooling is performed to stop the reaction, and thus, a polyester resin is synthesized. When a weight average molecular weight (Mw) of the obtained polyester resin is measured by gel permeation chromatography (polystyrene conversion), the weight average molecular weight is 25,000.

Then, 3,000 parts of the obtained polyester resin, 10,000 parts of ion exchange water, and 90 parts of sodium dodecylbenzenesulfonate as a surfactant are added to a emulsification tank of a high temperature and high pressure emulsification device (CAVITRON CD1010, slit: 0.4 mm), heated and melted at 130° C., dispersed at 110° C., a flow rate of 3 L/m, and 10,000 rotations for 30 minutes, and is caused to pass a cooling tank to collect a crystalline polyester resin dispersion (high temperature and high pressure emulsification device (CAVITRON CD1010, slit: 0.4 mm, manufactured by Eurotec Ltd.), and thus, a polyester resin dispersion (1) having solid content of 20% is obtained.

Preparation of Polyester Resin Dispersion (2)

| | |
|---|---|
| Ethylene oxide adduct of bisphenol A: | 15 parts by mol |
| Propylene oxide adduct of bisphenol A: | 85 parts by mol |
| Terephthalic acid: | 10 parts by mol |
| Fumaric acid: | 67 parts by mol |
| n-dodecenylsuccinic acid: | 3 parts by mol |
| Trimellitic acid: | 20 parts by mol |

The above components are put in a heated and dried three-necked flask. Dibutyl tin oxide, the amount of which is 0.05 parts by mol with respect to the above acid components (total mole number of terephthalic acid, n-dodecenylsuccinic acid, trimellitic acid, and fumaric acid) is put therein. Then, nitrogen gas is introduced into the vessel to maintain the air in an inert atmosphere and the temperature is increased so that co-polycondensation is performed at 150° C. to 230° C. for 12 hours to 20 hours. After that, the pressure is slowly reduced at 210° C. to 250° C., and thus, the polyester resin is synthesized. The weight average molecular weight (Mw) of the resin is 65,000. Then, 3,000 parts of the obtained polyester resin, 10,000 parts of ion exchange water, and 90 parts of sodium dodecylbenzenesulfonate as a surfactant are added to a emulsification tank of a high temperature and high pressure emulsification device (CAVITRON CD1010, slit: 0.4 mm), heated and melted at 130° C., dispersed at 110° C., a flow rate of 3 L/m, and 10,000 rotations for 30 minutes, and is caused to pass a cooling tank to collect a polyester resin dispersion (high temperature and high pressure emulsification device (CAVITRON CD1010, slit: 0.4 mm, manufactured by Eurotec Ltd.), and thus, a polyester resin dispersion (2) having solid content of 20% is obtained.

Preparation of Colorant Particle Dispersion (1)

| | |
|---|---|
| Cyan pigment (copper phthalocyanine, C.I. Pigment Blue 15:3 manufactured by Dainichiseika Color & Chemicals Mfg. Co., Ltd.): | 100 parts |
| Anionic surfactant NEOGEN RK (manufactured by DKS Co., Ltd.): | 10 parts |
| Ion exchange water: | 400 parts |

The above materials are mixed with each other and dispersed using a homogenizer (ULTRA TURRAX T50 manufactured by IKA Works, Inc.) for 10 minutes, ion exchange water is added thereto, and thus, a colorant particle dispersion (1) having a volume average particle diameter of 190 nm and solid content of 20% is obtained.

Preparation of release agent particle dispersion (1)

| | |
|---|---|
| Paraffin Wax (HNP9 manufactured by Nippon Seiro Co., Ltd.: melting temperature of 75° C.): | 46 parts |

-continued

| | |
|---|---|
| Anionic surfactant NEOGEN RK (manufactured by DKS Co., Ltd.): | 5 parts |
| Ion exchange water: | 200 parts |

The above components are mixed with each other and heated to 100° C., and sufficiently dispersed using a homogenizer (ULTRA TURRAX T50 manufactured by IKA Works, Inc.) Then, the mixture is dispersed using a PRESSURE DISCHARGE TYPE GAULIN HOMOGENIZER (manufactured by Gaulin Co., Ltd.) and thus, a release agent particle dispersion (1) having a volume average particle diameter of 200 nm and solid content of 20% is obtained.

Preparation of Toner Particles (A-1)

| | |
|---|---|
| Polyester resin dispersion (1): | 33 parts |
| Polyester resin dispersion (2): | 257 parts |
| Colorant particle dispersion (1): | 27 parts |
| Release agent particle dispersion (1): | 35 parts |

The above components are put in a stainless steel flask, and mixed and dispersed using a homogenizer (ULTRA TURRAX T50 manufactured by IKA Works, Inc.) Then, 0.20 parts of polyaluminum chloride is added thereto and the dispersion operation is continued using the homogenizer. The flask is heated to 48° C. while stirring the components in the flask in a heating oil bath. After maintaining the flask at 48° C. for 60 minutes, 70 parts of the polyester resin dispersion (2) is additionally added thereto. Then, after adjusting the pH in the system to 8.0 using 0.5 N sodium hydroxide aqueous solution, the stainless steel flask is sealed, heated to 96° C. while continuing stirring using magnetic seal, and kept for 3 hours. After the reaction ends, the mixture is cooled, filtered, and washed with ion exchange water, and solid-liquid separation is performed by Nutsche-type suction filtration. In addition, the solid content is dispersed again using 1,000 parts of ion exchange water at 30° C., stirred and washed at 300 rpm for 15 minutes. This operation is further repeated five times. When the pH of the filtrate is 7.5 and electrical conductivity is 7.0 μS/cm, the solid-liquid separation is performed by Nutsche-type suction filtration using No. 5A filter paper. Next, vacuum drying is continued for 12 hours and thus, toner particles (A-1) are obtained.

When a volume average particle diameter of the obtained toner particles (A-1) is measured by the well-known method, the volume average particle diameter is 5.8 μm.

When the maximum frequent value and the skewness of the distribution of the eccentricity B of the release agent domain are measured, the maximum frequent value is 0.65 and the skewness is −0.50.

Preparation of Toner Particles (A-2)

The components used in the toner particles (A-1) are put in a stainless steel flask and mixed and dispersed using a homogenizer (ULTRA TURRAX T50 manufactured by IKA Works, Inc.) Then, the flask is heated to 30° C. while stirring the components in the flask in a heating oil bath. The flask is maintained at 30° C. for 20 minutes. After increasing the temperature of the heating oil bath and maintaining the flask at 45° C. for 60 minutes, 26 parts of the polyester resin dispersion (2) is additionally added thereto, and the temperature of the heating oil bath is increased to 50° C. and maintained for 20 minutes. Then, after adjusting the pH in the system to 5.0 using 1 N sodium hydroxide, the stainless steel flask is sealed, heated to 80° C. while continuing stirring using magnetic seal, and kept for 3 hours. After the reaction ends, cooling, the solid-liquid separation, and vacuum drying are performed by the same method as that of the toner particles (A-1) to thereby obtain toner particles (A-2).

When a volume average particle diameter of the obtained toner particles (A-2) is measured by the well-known method, the volume average particle diameter is 4.1 μm.

When the maximum frequent value and the skewness of the distribution of the eccentricity B of the release agent domain are measured, the maximum frequent value is 0.70 and the skewness is −0.60.

Preparation of Toner Particles B

Preparation of Polyester Resin Dispersion (3)

| | |
|---|---|
| Ethylene oxide adduct of bisphenol A: | 5 parts by mol |
| Propylene oxide adduct of bisphenol A: | 95 parts by mol |
| Terephthalic acid: | 30 parts by mol |
| Fumaric acid: | 70 parts by mol |

The above components are put in a 5-liter flask equipped with a stirrer, a nitrogen gas introducing tube, a temperature sensor, and a rectifying column. Then, the temperature is increased to 210° C. for 1 hour, and 1 part of titanium tetraethoxide is added to 100 parts of the above material. The temperature is increased to 230° C. for 0.5 hours while distilling away generated water, a dehydration condensation reaction is continued at this temperature for 1 hour, and then the reactant is cooled to thereby obtain a polyester resin. When a weight average molecular weight (Mw) of the obtained polyester resin is measured by gel permeation chromatography (polystyrene conversion), the weight average molecular weight is 18,500.

Then, 40 parts of ethyl acetate and 25 parts of 2-butanol are added to set a mixed solution, 100 parts of the polyester resin is slowly added and dissolved, and 10% by weight ammonia aqueous solution (equivalent to the amount of three times the acid value of the resin by a molar ratio) is added thereto and stirred for 30 minutes.

Next, the atmosphere in the vessel is substituted with dry nitrogen, the temperature is maintained at 40° C., and 400 parts of ion exchange water is added thereto dropwise at a rate of 2 part/min, while stirring the mixed solution, to thereby perform emulsification. After performing dropwise adding, the temperature of the emulsified solution is returned to room temperature (20° C. to 25° C.), bubbling is performed for 48 hours by dry nitrogen while stirring, to decrease the content of ethyl acetate and 2-butanol to be equal to or smaller than 1,000 ppm, and thus, a resin particle dispersion in which resin particles having a volume average particle diameter of 200 nm are dispersed is obtained. Ion exchange water is added to the resin particle dispersion to thereby obtain a polyester resin dispersion (3) having solid content of 20% by weight.

Preparation of Toner Particles (B-1)

An apparatus (see FIG. 3) which connects a round stainless steel flask and a vessel A to each other through a tube pump A, transmits a solution contained in the vessel A to the flask by the driving of the tube pump A, connects the vessel A and a vessel B to each other through a tube pump B, and transmits a solution contained in the vessel B to the vessel A by the driving of the tube pump B is prepared. The following operations are performed using this apparatus.

| | |
|---|---|
| Polyester resin dispersion (3): | 500 parts |
| Colorant particle dispersion (1): | 40 parts |
| Anionic surfactant (TaycaPower): | 2 parts |

The above materials are put into the round stainless steel flask, 0.1 N of nitric acid is added to adjust the pH to 3.5, and then, 30 parts of a nitric acid aqueous solution having polyaluminum chloride concentration of 10% by weight is added. Then, the resultant material is dispersed at 30° C. using a homogenizer (ULTRA TURRAX T50 manufactured by IKA Works, Inc.) and thus, a particle diameter of aggregated particles is increased while increasing a temperature at a rate of 1° C./30 min in a heating oil bath.

Meanwhile, 150 parts of the polyester resin dispersion (3) is put into the vessel A of a polyester bottle and 25 parts of the release agent particle dispersion (1) is put into the vessel B in the same manner. Then, a solution transmission rate of the tube pump A is set as 0.70 part/1 min, a solution transmission rate of the tube pump B is set as 0.14 part/1 min, the tube pumps A and B are driven when a temperature in the round stainless steel flask during the formation of aggregating particles reached 37° C., and transmission of each dispersion is started. Accordingly, a mixed dispersion in which the resin particles and the release agent particles are dispersed is transmitted to the round stainless steel flask from the vessel A during the formation of the aggregated particles, while slowly increasing concentration of the release agent particles.

The resultant material is maintained for 30 minutes after the transmission of each of dispersions to the flask is completed and the temperature in the flask becomes 48° C., and thus, the second aggregated particles are formed.

After that, 50 parts of the polyester resin dispersion (3) is slowly added thereto and maintained for 1 hour. After adjusting the pH to 8.5 by adding 0.1 N sodium hydroxide aqueous solution, the temperature is increased to 85° C. while continuing the stirring, and maintained for 5 hours. Then, the temperature is decreased to 20° C. at a rate of 20° C./min, the resultant material is filtered, sufficiently washed with ion exchange water, and dried, to obtain toner particles (B-1).

When a volume average particle diameter of the obtained toner particles (B-1) is measured by the well-known method, the volume average particle diameter is 6.0 μm.

When the maximum frequent value and the skewness of the distribution of the eccentricity B of the release agent domain are measured, the maximum frequent value is 0.88 and the skewness is −0.80.

Preparation of Toner Particles (B-2)

Toner particles (B-2) are obtained in the same manner as in the preparation of the toner particles (B-1), except for setting the solution transmission rate of the tube pump A to 0.70 part/1 min, and the solution transmission rate of the tube pump B to 0.14 part/1 min, and driving the tube pumps A and B when the temperature in the flask reached 40.0° C.

When a volume average particle diameter of the obtained toner particles (B-2) is measured by the well-known method, the volume average particle diameter is 6.0 μm.

When the maximum frequent value and the skewness of the distribution of the eccentricity B of the release agent domain are measured, the maximum frequent value is 0.97 and the skewness is −0.79.

Preparation of Toner Particles (B-3)

Toner particles (B-3) are obtained in the same manner as in the preparation of the toner particles (B-1), except for setting the solution transmission rate of the tube pump A to 0.85 part/1 min, and the solution transmission rate of the tube pump B to 0.14 part/1 min, and driving the tube pumps A and B when the temperature in the flask reached 37.0° C.

When a volume average particle diameter of the obtained toner particles (B-3) is measured by the well-known method, the volume average particle diameter is 6.0 μm.

When the maximum frequent value and the skewness of the distribution of the eccentricity B of the release agent domain are measured, the maximum frequent value is 0.85 and the skewness is −0.52.

Preparation of Toner Particles C

Preparation of Unmodified Polyester Resin (1)

| | |
|---|---|
| Terephthalic acid: | 1243 parts |
| Ethylene oxide adduct of bisphenol A: | 1830 parts |
| Propylene oxide adduct of bisphenol A: | 840 parts |

The above components are heated to 180° C. and mixed with each other, 3 parts of dibutyl tin oxide is added thereto, water is distilled away while heating at 220° C., and thus, a polyester resin is obtained. 1,500 parts of cyclohexanone is added to the obtained polyester to dissolve the polyester resin, and 250 parts of acetic anhydride is added to this cyclohexanone solution and heated at 130° C. This solution is heated, a pressure thereof is reduced to remove the solvent and the unreacted acid, and thus, an unmodified polyester resin (1) is obtained. A glass transition temperature of the obtained unmodified polyester resin (1) is 60° C.

Preparation of Polyester Prepolymer (1)

| | |
|---|---|
| Terephthalic acid: | 1243 parts |
| Ethylene oxide adduct of bisphenol A: | 1830 parts |
| Propylene oxide adduct of bisphenol A: | 840 parts |

The above components are heated to 180° C. and mixed with each other, 3 parts of dibutyl tin oxide is added thereto, water is distilled away while heating at 220° C., and thus, a polyester prepolymer is obtained. 350 parts of the obtained polyester prepolymer, 50 parts of tolylenediisocyanate, and 450 parts of ethyl acetate are put into a vessel and a mixture thereof is heated at 130° C. for 3 hours to thereby obtain a polyester prepolymer (1) including an isocyanate group (hereinafter, an "isocyanate-modified polyester prepolymer (1)").

Preparation of Ketimine Compound (1)

50 parts of methyl ethyl ketone and 150 parts of hexamethylene diamine are put into a vessel and stirred at 60° C. to obtain a ketimine compound (1).

Preparation of release agent particle dispersion (2)

| | |
|---|---|
| Paraffin Wax (melting temperature of 89° C.): | 30 parts |
| Ethyl acetate: | 270 parts |

The above components are subjected to wet pulverization by a micro beads dispersing machine (DCP mill) in a state of being cooled to 10° C., thereby obtaining a release agent particle dispersion (2).

Preparation of Oil-Phase Solution (1)

| | |
|---|---|
| Unmodified polyester resin (1): | 136 parts |
| Ethyl acetate: | 56 parts |

After stirring and mixing the above components, 75 parts of the release agent particle dispersion (2) is added to the obtained mixture, and the mixture is stirred to obtain an oil-phase solution (1).

Preparation of Styrene Acrylic Resin Particle Dispersion (1)

| | |
|---|---|
| Styrene: | 370 parts |
| n butyl acrylate: | 30 parts |
| Acrylic acid: | 4 parts |
| Dodecanethiol: | 24 parts |
| Carbon tetrabromide: | 4 parts |

The above components are mixed with each other, the dissolved mixture is dispersed and emulsified in a water-soluble solution obtained by dissolving 6 parts of a nonionic surfactant (NONIPOL 400 manufactured by Sanyo Chemical Industries, Ltd.) and 10 parts of an anionic surfactant (NEOGEN SC manufactured by DKS Co., Ltd.) in 560 parts of ion exchange water, in a flask, an aqueous solution obtained by dissolving 4 parts of ammonium persulfate in 50 parts of ion exchange water while mixing for 10 minutes, nitrogen substitution is performed, and then the heating is performed in an oil bath until the temperature of the content becomes 70° C. while stirring the materials in the flask, and emulsification and polymerization are continued for 5 hours. Thus, a styrene acrylic resin particle dispersion (1) in which resin particles having an average particle diameter of 180 nm and a weight average molecular weight (Mw) of 15,500 are dispersed (resin particle concentration: 40% by weight) is obtained. A glass transition temperature of the styrene acrylic resin particles is 59° C.

Preparation of Water-Phase Solution (1)

| | |
|---|---|
| Styrene acrylic resin particle dispersion (1): | 60 parts |
| 2% water-soluble solution of SEROGEN BS-H (manufactured by DKS Co., Ltd.): | 200 parts |
| Ion exchange water: | 200 parts |

The above components are stirred and mixed with each other to obtain a water-phase solution (1).

Preparation of Toner Particles (C-1)

| | |
|---|---|
| Oil-phase solution (1): | 300 parts |
| Isocyanate-modified polyester prepolymer (1): | 25 parts |
| Ketimine compound (1): | 0.5 parts |

After putting the above components in a vessel and stirring the components using a homogenizer (ULTRA TURRAX T50 manufactured by IKA Works, Inc.) for 2 minutes to obtain an oil-phase solution (1P), 1,000 parts of water-phase solution (1) is added to the vessel and stirred using a homogenizer for 20 minutes. Then, the mixed solution is stirred using a propeller-attached stirrer at room temperature (25° C.) under ordinary pressure (1 atmospheric pressure) for 48 hours, a reaction between isocyanate-modified polyester prepolymer (1) and the ketimine compound (1) are allowed to form a urea-modified polyester resin, the organic solvent is removed, and particulates are formed. Next, the particulates are washed, dried, and classified, to thereby obtain toner particles (c-1).

When a volume average particle diameter of the obtained toner particles (C-1) is measured by the well-known method, the volume average particle diameter is 6.1 μm.

When the maximum frequent value and the skewness of the distribution of the eccentricity B of the release agent domain are measured, the maximum frequent value is 0.66 and the skewness is −0.60.

Preparation of Toner

Example 1

1.0 part of titanium oxide particles (average primary particle diameter of 15 nm, JMT-150IB manufactured by TAYCA) and 1.5 parts of silica particles (average primary particle diameter of 40 nm, AEROSIL RY50 manufactured by Nippon Aerosil co. Ltd.) are added with respect to 100 parts of the toner particles A-1 and stirred using a HENSCHEL MIXER at a circumferential speed of 40 m/sec for 10 minutes. Then, the mixture is sieved using a wind classifier (for example, HI-BOLTER 300 manufactured by Shin Tokyo Kikai). After that, 0.5 parts of zinc stearate particles (Znst1) are added from the upper portion of a collecting tank of the CYCLONE collector and the operation of the CYCLONE collector is stopped after 5 minutes to thereby obtain a toner of Example 1.

Comparative Example 1

1.0 part of titanium oxide particles (average primary particle diameter of 15 nm, JMT-150IB manufactured by TAYCA), 1.5 parts of silica particles (average primary particle diameter of 40 nm, AEROSIL RY50 manufactured by Nippon Aerosil co. Ltd.), and 0.5 parts of the zinc stearate particles (Znst1) are added with respect to 100 parts of the toner particles (A-1) and stirred using a HENSCHEL MIXER at a circumferential speed of 40 m/sec for 10 minutes. After that, the mixture is sieved using a vibrating sieve having an aperture of 45 μm, and thus, a toner of Comparative Example 1 is prepared.

Comparative Example 2

1.5 parts of silica particles (UFP-35 manufactured by Nihon Anodizing Co., Ltd.) is added to 100 parts of the toner particles (A-1), stirred using a HENSCHEL MIXER at a circumferential speed of 13 m/sec for 1 minute, and further stirred at a circumferential speed of 40 m/sec for 10 minutes. 0.5 parts of titanium oxide particles having a volume average particle diameter of 20 nm is added thereto, stirred using a HENSCHEL MIXER at a circumferential speed of 13 m/sec for 1 minute, and further stirred at a circumferential speed of 40 m/sec for 10 minutes. 2.0 parts of silica particles (H1303 manufactured by Clariant) is further added thereto, stirred using a HENSCHEL MIXER at a circumferential speed of 13 m/sec for 1 minute, and further stirred at a circumferential speed of 40 m/sec for 10 minutes. 0.2 parts of zinc stearate particles (Znst1) is added thereto, stirred using a HENSCHEL MIXER at a circumferential speed of 13 m/sec for 1 minute, and further stirred at a circumferential speed of 40 m/sec for 10 minutes. After finishing the stirring, the mixture is allowed to pass through mesh having an aperture of 500 μm to remove coarse powder, and thus, a toner of Comparative Example 2 is prepared.

Comparative Examples 3 and 4

A toner of Comparative Example 3 is prepared in the same manner as in the preparation of the toner of Comparative Example 1 except for stirring at a circumferential speed of 40 m/sec for 15 minutes instead of stirring at a circumferential speed of 40 m/sec for 10 minutes with a HENSCHEL MIXER.

A toner of Comparative Example 4 is prepared in the same manner as in the preparation of the toner of Comparative Example 2 except for stirring at a circumferential speed of 13 m/sec for 5 minutes after adding the zinc stearate particles instead of stirring at a circumferential speed of 13 m/sec for 1 minute and at a circumferential speed of 40 m/sec for 10 minutes.

Examples 2 to 6

Toners of Examples 2 to 6 are prepared in the same procedure in Example 1, except for changing the time from the addition of 0.5 parts of zinc stearate particles (Znst1) from the upper portion of a collecting tank of the CYCLONE collector to the stop of the operation of the CYCLONE collector. The time until the operation of the CYCLONE collector is stopped is as follows.

Example 2: 7 minutes
Example 3: 10 minutes
Example 4: 12 minutes
Example 5: 3 minutes
Example 6: 2 minutes Examples 7 to 14

According to Table 1, toners of Examples 7 to 14 are prepared in the same procedure as that of the toner prepared in Example 1, except for changing the type of the toner particles and the type of the fatty acid metal salt particles.

Preparation of Carrier

| | |
|---|---|
| Ferrite particles (average particle diameter: 50 μm, volume electric resistance: $3 \times 10^8$ Ω · cm): | 100 parts |
| Toluene: | 14 parts |
| Perfluorooctyl ethyl acrylate/dimethylaminoethyl methacrylate copolymer (copolymerization ratio 90:10, Mw: 50,000): | 1.6 parts |
| Carbon black (VXC-72 manufactured by Cabot Corporation): | 0.12 parts |

The above components excluding the ferrite particles are dispersed by a stirrer for 10 minutes to prepare a coating film forming solution, this coating film forming solution and the ferrite particles are put into a vacuum degassing type kneader, and are stirred at 60° C. for 30 minutes, and toluene is removed under the reduced pressure, to form a resin coating film on the surface of the ferrite particles, and thus, a carrier is prepared. A volume average particle diameter of the obtained carrier is 51 μm.

Preparation of Developer 8 parts of the toner obtained in each example is mixed with respect to 100 parts of the carrier prepared as described above and stirred using a V-blender for 20 minutes, and thus, a developer is obtained.

Evaluation

The prepared developer is accommodated in a developing device of remodeled "DOCUCENTRE COLOR 450" manufactured by Fuji Xerox Co., Ltd. and is kept in the high temperature high humidity environment (temperature of 40° C. and humidity of 90% RH) for a day. After that, 30 sheets of images having an area coverage (image density) of 10% are printed on a position separated from the edge of the sheet by 3 cm in a paper feeding direction (image 1). Then, 100,000 sheets of images having an area coverage of 80% are printed (image 2). Further, 30 sheets of images having an area coverage of 10% are printed again to be on the same position as that of the image 1 (image 3).

Evaluation of Image Density

In the image 2 (image having an area coverage of 80%), image density of 10th image and image density of 100,000th image are measured using an image densitometer (X-RITE 938: manufactured by X-Rite, Inc.) and a difference between the measurement results of the image density (Δ image density: image density of 100,000th image−image density of 10th image) is determined to perform the determination based on the following evaluation criteria. Levels up to G3 are acceptable range.

Evaluation Criteria

G1: 0<Δ image density≤0.03

G2: 0.03<Δ image density≤0.06

G3: 0.06<Δ image density≤0.10

G4: 0.10<Δ image density≤0.20

G5: 0.20<Δ image density

Evaluation of Out of Color Registration (Positional Deviation of Image)

Regarding 30 sheets of the image 1 (image having an area coverage of 10% which is initially printed) and 30 sheets of the image 3 (image having an area coverage of 10% which is finally printed), a distance between the paper edge portion and the formed image is measured to perform the determination based on the following evaluation criteria. Levels up to G3 are acceptable range.

The distance between the paper edge portion and the formed image is an average value.

Evaluation Criteria

G1: 0<out of color registration amount≤0.5 mm

G2: 0.5 mm<out of color registration amount≤1.0 mm

G3: 1.0 mm<out of color registration amount≤2 mm

G4: 2 mm<out of color registration amount (paper feeding failure)≤5 mm

G5: 5 mm<out of color registration amount (paper feeding failure)

In Table 1, "Znst" indicates the "zinc stearate" and "Znla" indicates the "zinc laurate", respectively.

The ratio "a/b" indicates the "volume average particle diameter of the toner particles/volume average particle diameter of the fatty acid metal salt particles".

From the above results, it is found that the results of the image evaluation are excellent in the examples, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin and a release agent; and an external additive containing fatty acid metal salt particles, wherein a non-attachment rate representing a percentage of the fatty acid metal salt particles not attached to the toner particles before ultrasonic desorption treatment is 45% or less, a weak attachment rate representing a percentage determined by subtracting the non-attachment rate from a percent of the fatty acid metal salt particles not attached to the toner particles after ultrasonic desorption treatment is 55% or more,

TABLE 1

| | Toner particles no. | Fatty acid metal salt particles no. | Particle diameter ratio a/b | Non-attachment rate % | Weak attachment rate % | Evaluation Image density | Evaluation Out of color registration |
|---|---|---|---|---|---|---|---|
| Example 1 | A-1 | Znst1 | 4.8 | 15 | 76 | G1 | G2 |
| Example 2 | A-1 | Znst1 | 4.8 | 14 | 80 | G1 | G1 |
| Example 3 | A-1 | Znst1 | 4.8 | 15 | 84 | G1 | G1 |
| Example 4 | A-1 | Znst1 | 4.8 | 15 | 65 | G1 | G3 |
| Example 5 | A-1 | Znst1 | 4.8 | 30 | 60 | G2 | G3 |
| Example 6 | A-1 | Znst1 | 4.8 | 40 | 56 | G3 | G3 |
| Example 7 | A-2 | Znst1 | 3.4 | 14 | 76 | G1 | G2 |
| Example 8 | A-1 | Znst2 | 6.4 | 10 | 78 | G1 | G2 |
| Example 9 | A-1 | Znst3 | 3.9 | 20 | 77 | G1 | G2 |
| Example 10 | A-1 | Znla1 | 3.9 | 20 | 76 | G1 | G2 |
| Example 11 | B-1 | Znst1 | 5 | 10 | 78 | G1 | G1 |
| Example 12 | B-2 | Znst1 | 5 | 5 | 85 | G1 | G1 |
| Example 13 | B-3 | Znst1 | 5 | 12 | 79 | G1 | G1 |
| Example 14 | C-1 | Znst1 | 5.1 | 20 | 75 | G1 | G2 |
| Comparative Example 1 | A-1 | Znst1 | 4.8 | 16 | 40 | G1 | G5 |
| Comparative Example 2 | A-1 | Znst1 | 4.8 | 25 | 50 | G2 | G4 |
| Comparative Example 3 | A-1 | Znst1 | 4.8 | 12 | 35 | G1 | G5 |
| Comparative Example 4 | A-1 | Znst1 | 4.8 | 50 | 49 | G5 | G4 |

the toner particles have a sea-island structure including a sea portion containing the binder resin and an island portion containing the release agent, a maximum frequent value in distribution of the following eccentricity B of the island portion containing the release agent is from 0.71 to 1.00, and a skewness in the distribution of the eccentricity B is from −1.10 to −0.50, the eccentricity B being represented by the following expression (1):

$$\text{eccentricity } B=2d/D, \qquad \text{Expression (1):}$$

wherein D indicates an equivalent circle diameter (μm) of the toner particle in an observation of a cross-section of the toner particle, and d indicates a distance (μm) from a centroid of the toner particle to a centroid of the island portion containing the release agent in the observation of a cross-section of the toner particle, and wherein the non-attachment rate and the weak attachment rate of the fatty acid metal salt particles in the toner are measured as follows:

a toner dispersion A is prepared by adding 3.75 g of toner to a 0.5% surfactant aqueous solution, and stirred at a rotation rate to an extent of not foaming using a table roll mill for 30 minutes;

ultrasonic waves are applied to the toner dispersion A, height of an ultrasonic vibrating unit from a bottom surface of 1.0 cm, intensity of 40 W, for 1 minute, forming a toner dispersion B;

the toner dispersion B is subjected to centrifugation at 2,000 rpm for 2 minutes;

suction filtration is performed using a material obtained by discarding a supernatant after the centrifugation and adding 60 mL of water to precipitated toner as a dispersion slurry;

after filtering, the toner remaining on a filter paper is collected and suction filtering is performed for cleaning using 60 mL of water as a dispersion slurry; and after cleaning, the toner remaining on the filter paper is collected and dried in at 40° C. for 8 hours;

3 g of the obtained toner is molded in a pellet having a diameter of 30 mm and a thickness of 2 mm, under conditions of a load of 6.0 t and pressing time of 60 seconds, to obtain a sample 1;

a sample prepared by the same procedures as those of the above process, except that the application of the ultrasonic waves is omitted, is set as a sample 2;

a toner that has not been subjected to the above process is separately molded in a pellet having a diameter of 30 mm and a thickness of 2 mm under the conditions of a load of 6.0 t and pressing time of 60 seconds, to obtain a sample 0;

quantitative analysis is performed by a fluorescence X-ray device, and a content of metal elements of each sample is measured;

the non-attachment rate is calculated by the following Expression (A):

$$\text{Non-attachment rate}=\{(C_0-C_2)/C_0\}\times 100, \qquad \text{Expression (A)}$$

wherein $C_0$ represents the content of metal elements of the sample 0 and $C_2$ represents the content of metal elements of the sample 2);

the weak attachment rate is calculated by the following Expression (Z):

$$\text{Weak attachment rate}=[\{(C_0-C_1)/C_0\}\times 100]-\text{non-attachment rate}, \qquad \text{Expression (Z)}$$

wherein, $C_0$ represents the content of metal elements of the sample 0 and $C_1$ represents the content of metal elements of the sample 1.

2. The electrostatic charge image developing toner according to claim 1, wherein the binder resin is a polyester resin.

3. The electrostatic charge image developing toner according to claim 2, wherein a glass transition temperature (Tg) of the polyester resin is from 50° C. to 80° C.

4. The electrostatic charge image developing toner according to claim 2, wherein a weight average molecular weight (Mw) of the polyester resin is from 5,000 to 1,000,000.

5. The electrostatic charge image developing toner according to claim 2, wherein a number average molecular weight (Mn) of the polyester resin is from 2,000 to 100,000.

6. The electrostatic charge image developing toner according to claim 2, wherein a molecular weight distribution Mw/Mn of the polyester resin is from 1.5 to 100.

7. The electrostatic charge image developing toner according to claim 1, wherein the toner particles further contain a urea-modified polyester resin.

8. The electrostatic charge image developing toner according to claim 7, wherein a glass transition temperature of the urea-modified polyester resin is from 40° C. to 65° C.

9. The electrostatic charge image developing toner according to claim 7, wherein the urea-modified polyester resin is a urea-modified polyester resin derived from a reaction between a polyester resin (polyester prepolymer) having an isocyanate group and an amine compound.

10. The electrostatic charge image developing toner according to claim 9, wherein the number of isocyanate groups contained per 1 molecule of the polyester prepolymer is from 1 to 3 on an average.

11. The electrostatic charge image developing toner according to claim 9, wherein an equivalent ratio [NCO]/[NHx] of an isocyanate group [NCO] of the polyester prepolymer having an isocyanate group and an amino group [NHx] of the amine compound is from 1/2 to 2/1.

12. The electrostatic charge image developing toner according to claim 1, wherein a content of the binder resin is from 40% by weight to 95% by weight with respect to the entirety of toner particles.

13. The electrostatic charge image developing toner according to claim 1, wherein a ratio (a/b) of a volume average particle diameter a of the toner particles and a volume average particle diameter b of the fatty acid metal salt particles satisfies a relationship of $2.5 \leq a/b \leq 7$.

14. The electrostatic charge image developing toner according to claim 1, wherein the fatty acid metal salt particles are zinc stearate particles.

15. The electrostatic charge image developing toner according to claim 1, wherein the amount of the fatty acid metal salt particles externally added is from 0.02 parts by weight to 5 parts by weight with respect to 100 parts by weight of the toner particles.

16. The electrostatic charge image developing toner according to claim 1, wherein a melting temperature of the release agent is from 50° C. to 110° C.

17. The electrostatic charge image developing toner according to claim 1, wherein a content of the release agent is from 1% by weight to 20% by weight with respect to the entirety of toner particles.

18. An electrostatic charge image developer comprising the electrostatic charge image developing toner according to claim 1.

19. A toner cartridge, comprising:

a container that contains the electrostatic charge image developing toner according to claim 1, wherein the toner cartridge is detachable from an image forming apparatus.

20. The electrostatic charge image developing toner according to claim 1, wherein the non-attachment rate representing the percentage of the fatty acid metal salt particles not attached to the toner particles before ultrasonic desorption treatment ranges from 5-45%.

* * * * *